US007399045B2

(12) United States Patent
Nishida et al.

(10) Patent No.: US 7,399,045 B2
(45) Date of Patent: Jul. 15, 2008

(54) IMAGE RECORDING APPARATUS

(75) Inventors: Toru Nishida, Kanagawa (JP); Toshitake Yui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 352 days.

(21) Appl. No.: 11/219,208

(22) Filed: Sep. 1, 2005

(65) Prior Publication Data

US 2006/0203029 A1 Sep. 14, 2006

(30) Foreign Application Priority Data

Mar. 9, 2005 (JP) ..... 2005-066138

(51) Int. Cl.
*B41J 29/38* (2006.01)
*B41J 2/015* (2006.01)

(52) U.S. Cl. ..... 347/14; 347/21

(58) Field of Classification Search ..... 347/14, 347/21, 13
See application file for complete search history.

(56) References Cited

FOREIGN PATENT DOCUMENTS

| | | |
|---|---|---|
| JP | 64-63185 | 3/1989 |
| JP | 2002-210947 | 7/2002 |

*Primary Examiner*—Shih-wen Hsieh
(74) *Attorney, Agent, or Firm*—Fildes & Outland, P.C.

(57) ABSTRACT

A double-sided printable image recording apparatus including a conveyer for conveying a recording medium, a fixed recording head for ejecting an aqueous ink and a treating liquid having nature of aggregating a colorant contained in the aqueous ink to a recording medium conveyed by the conveyer, which is arranged in a direction substantially orthogonal to a conveying direction of the recording medium, and has a printing region of a recording medium width, and an ejection controller for controlling ejection of the aqueous ink and the treating liquid from the fixed recording head based on image information, wherein the ejection controller, in a double-sided printing mode of printing on both sides of the recording medium, controls an ejection amount of a treating liquid ejected per recording medium to a smaller amount than that of a single-sided printing mode of printing only on one side, at least on a surface of a recording medium.

18 Claims, 15 Drawing Sheets

10
18
46L
46Y
46M
46C
46K
42
42
42
20
42A
44
12
44
44
44

IMAGE RECORDING APPARATUS

CROSS REFERENCE TO RELATED APPLICATIONS

This application claims priority under 35 USC 119 from Japanese Patent Application No. 2005-66138, the disclosure of which is incorporated herein by reference.

BACKGROUND OF THE INVENTION

1. Field of the Invention

The present invention relates to an image recording apparatus and, in particularly, to a double-sided printable image recording apparatus, which is a two-liquid printing method and has a fixed recording head having a printing region of a recording medium width.

2. Description of the Related Art

A printing method using an ink jet method is advantageous in that an apparatus can be made smaller, noise is low, and running costs are low. However, in an aqueous ink jet printer, the solvent for an ink used is water, and simultaneously achieving both improved drying property of ink and improved image quality has hitherto been an extremely pressing challenge.

In order to solve this problem, for example, Japanese Patent Application Laid-Open (JP-A) No 64-63185 discloses a two-liquid printing method using a treating liquid together with an ink, which increases the viscosity or aggregation of the ink, and Japanese Patent No. 3158004 describes a method of adjusting ejection of the treating liquid in accordance with the surrounding environment. Or, as described in JP-A No. 2002-210947, a method of changing the dot diameter of ink and the amount of a treating liquid to be imparted during high speed printing and low speed printing, has been proposed.

In addition, in recent years, in order to enable high speed printing of ink jet printer, an aqueous ink jet printer fitted with a fixed recording head having a printing region corresponding to the width of a recording medium (hereinafter, referred to as "FWA (Full Width Array)") has been developed.

In an ink jet printer fitted with FWA, since there is no movement in a main scanning direction, printing speed is dramatically increased. On the other hand, curl and cockle of paper is generated due to the high speed of the printing, and conveyance becomes problematic. In addition, it becomes necessary to improve image quality in terms of bleeding, offset of ink, and the like.

In particular, in order to perform double-sided printing, these points requiring improvement are all the more prominent, and methods of solving them have been urgently demanded. That is, in a double-sided printable image recording apparatus in which a two-liquid printing system is applied, and which has a fixed recording head having a printing region of a recording medium width, development of an image recording apparatus which can provide better printing image quality on both the front surface and the back surface of a recording medium has been urgently demanded.

SUMMARY OF THE INVENTION

The present invention has been made in view of the above circumstances and provides double-sides printable image recording apparatus.

An aspect of the present invention is to provide a double-sided printable image recording apparatus comprising: a conveyer to convey a recording medium; a fixed recording head to eject an aqueous ink and a treating liquid capable of aggregating a colorant contained in the aqueous ink to the recording medium conveyed by the conveyer, which is arranged in a direction substantially orthogonal to a conveying direction of the recording medium, and has a printing region corresponding to the width of the recording medium; and an ejection controller to control ejection of the aqueous ink and the treating liquid from the fixed recording head based on image information, wherein the ejection controller, in a double-sided printed mode for printing on both sides of the recording medium, controls an ejection amount of the treating liquid ejected per sheet of the recording medium to a smaller amount than the amount in a single-sided printing mode for printing only on one side, at least on a front surface of the recording medium.

DETAILED DESCRIPTION OF THE INVENTION

The image recording apparatus of the present invention is a double-sided printable image recording apparatus having a conveyers to convey a recording medium, a fixed recording head to eject an aqueous ink and a treating liquid, which has the property of aggregating a colorant contained in the aqueous ink, to a recording medium conveyed by the conveyers, which is arranged in a substantially orthogonal to the conveying direction of the recording medium and has a printing region corresponding to the width of a recording medium, and an ejection controllers to control ejection of the aqueous ink and the treating liquid from the fixed recording head based on image information, wherein the ejection controllers, in a double-sided printing mode for printing on both sides of the recording medium, controls the ejection amount of treating liquid ejected on the front surface of a recording medium per sheet of a recording medium to be a smaller amount than the amount in a single-sided printing mode for printing on one side.

As such, in the present invention, control is performed by changing the amount of treating liquid respectively between the double-sided printing mode and the single-sided printing mode. Further, together with the change in the amount of treating liquid to be imparted in the double-sided printing mode, in order to adjust the optical density of an image formed on the recording medium, it is preferable to also control the application amount of ink to be imparted.

First, the structure of the image recording apparatus of the present invention are explained, and then, the control of ejection of ink and treating liquid as characteristic to the present invention is explained and, subsequently, a composition of ink and treating liquid as applied to the present invention is explained. When explanation is made with reference to the drawings, the same reference number is given to the same member throughout, and repeated explanation is omitted.

1. Image Recording Apparatus

Figure 1:
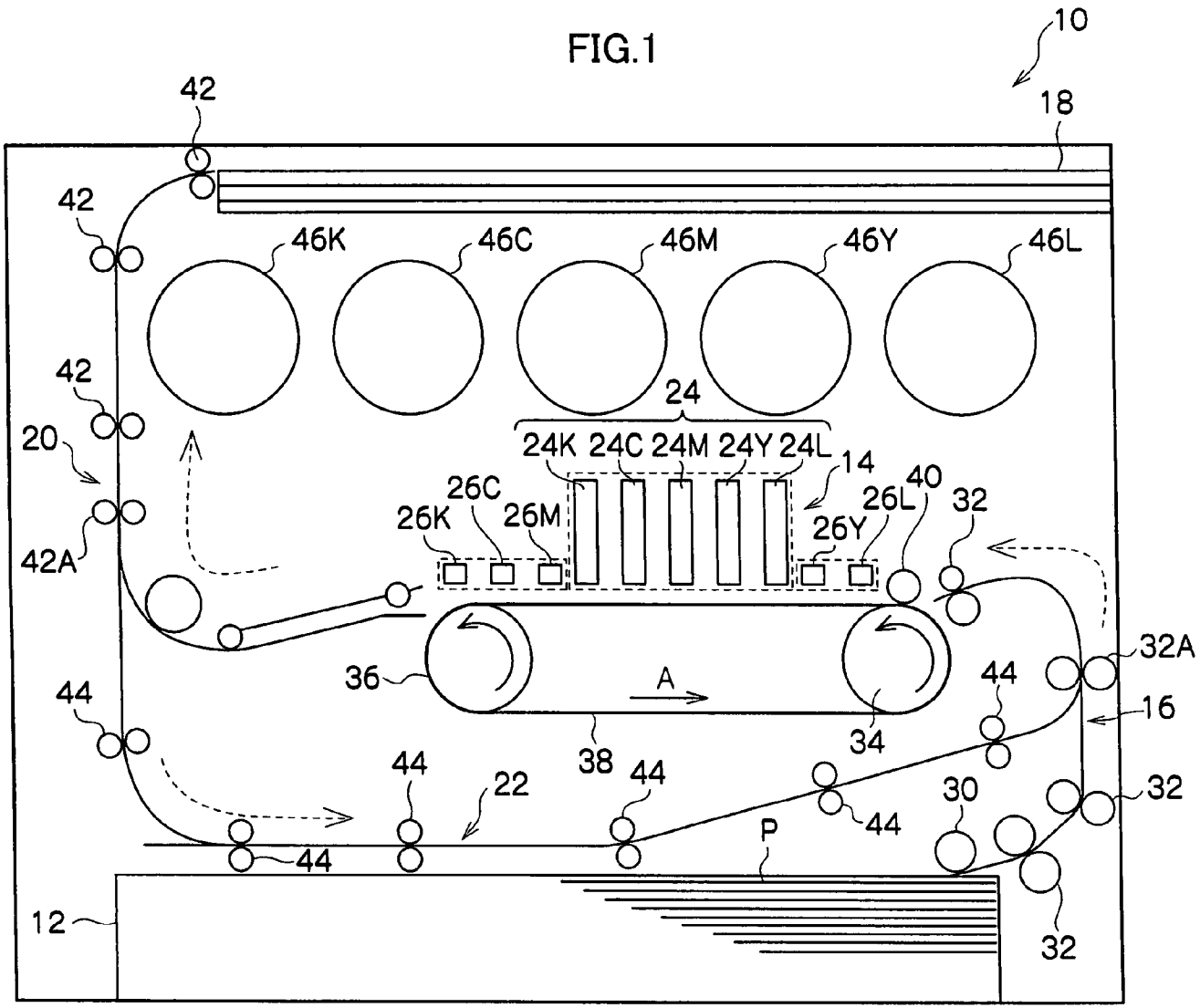
FIG. 1 is a schematic view showing one example of a double-sided ink jet printer employing an FWA-fitted two-liquid printing system of the present invention.

FIG. 1 shows a schematic view of one example of a double-sided ink jet printer of a two-liquid printing system fitted with FWA.

In FIG. 1, a recording paper P in a paper feeding tray 12 is taken out with a pickup roller 30 one by one, and is sent to an ejecting portion 14 by a first conveying portion 16. The first conveying portion 16 has a plurality of conveyance roller pairs 32 for conveying a paper, which are disposed at appropriate positions, and a recording paper P is re-supplied to a prescribed conveyance roller pair 32A from an inversion portion 22. The ejecting portion 14 is provided with conveying belt 38 which is winded by a driving roller 34 disposed on an upstream side in a paper conveying direction and a follow-up roller 36 disposed on a downstream side. The conveying belt 38, which is circulation-driven in an arrow A direction of FIG. 1, is disposed for facing a printing surface of a recording paper P with an ink jet recording head 24. At an upper portion of a driving roller 34, a nip roller 40 is slidingly contact against the conveying belt 38 from a surface side.

A second conveying portion 20 has a plurality of conveying roller pairs 42 for conveying a paper, which are disposed at appropriate positions, and a prescribed conveying roller pair 42A can send a recording a paper P to an inversion portion 22. In a double-sided printing mode, a paper is inverted at a conveying roller pair 42A, and the paper is conveyed to an inversion portion 22. The inversion portion 22 has a plurality of conveying roller pairs 44 for conveying a paper, which are disposed at appropriate positions, and conveys a recording paper P from a conveying roller pair 42A to a conveying roller pair 32A at the position where a printed surface becomes an upper side, allowing a back surface to be printed by a single pass.

Although not shown in the figure, the image recording apparatus has CPU for controlling an image forming apparatus 10, and has an ejection controller for controlling ejection of a treating liquid and an ink, a machine controller for controlling driving of a carriage motor or a linefeed motor, a detector and/or switch controller for controlling operating a detector and/or switch, a display element controller for controlling a display panel, and a memory portion for memorizing data of an optical density of an image and an ejection amount of a treating liquid and an ink, or pre-inputted data. CPU operates data as necessary, and directs each controlling portion.

It is preferable that an ink jet recording head 24 adopts a thermal ink jet recording method or a piezo ink jet recording method from a viewpoint of the effect of improving bleeding and bleeding between colors.

In the case of a thermal ink jet recording method, since an ink is heated at ejection, a viscosity of the ink becomes low, but a temperature of ink on a recording medium is lowered, and a viscosity is rapidly increased, therefore, this method has an effect of improving bleeding and bleeding between colors.

On the other hand, in the case of a piezo ink jet recording method, since a liquid having a high viscosity can be ejected, and a liquid having a high viscosity can suppress widening in a paper surface direction on a recording medium, this method has the effect of improving bleeding and bleeding between colors.

In the image forming apparatus of the present invention, a two-liquid printing method is adopted in which an ink, and a treating liquid having the action of aggregating and/or insolubilizing components of the ink are ejected on a recording medium so that the ink and the treating liquid are contacted, to form an image. An ink jet recording head 24 is arranged in a direction orthogonal to a conveying direction of a recording medium, has a printing region corresponding to the width of the recording medium, and is provided with FWA24L, 24Y, 24M, 24C, and 24K for ejecting a treating liquid and an ink. FWA24L, 24Y, 24M, 24C, and 24K are connected to ink tanks 46L, 46Y, 46M, 46C, and 46K, respectively, via a liquid supplying route such as a tube not shown, and a liquid solution and an ink are supplied from an each ink tank.

By contact of ink and a treating liquid, ink components are aggregated and/or insolubilized. Therefore, this recording method is excellent in view point of color developing property, a plain portion scattering, an optical density, bleeding, bleeding between colors, and a drying speed.

Maintenance units 26L, 26Y, 26M, 26C, and 26K perform the maintenance (filling of ink into a head, wiping of a nozzle surface, purging (flushing) for preventing increase in a viscosity etc.) for an ink jet recording head 24 (FWA).

Figure 2:
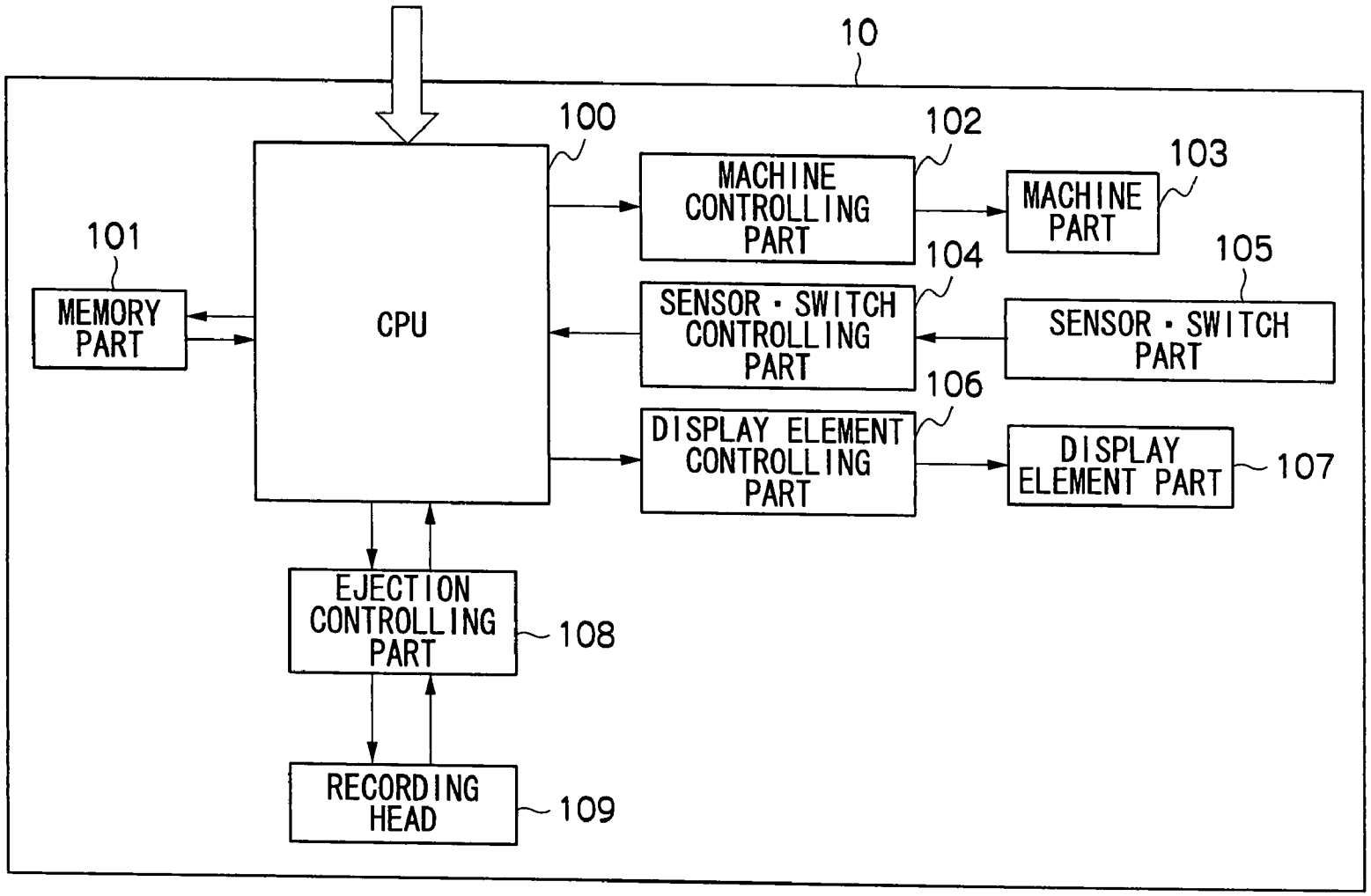
FIG. 2 is a block diagram of the image forming apparatus of the present invention.

FIG. 2 is a block diagram of the image forming apparatus of the present invention.

Data of letters and images to be printed (hereinafter referred to as "image data") and other data are sent to a memory portion 101 under administration of CPU100. A machine controlling portion 102 drives a machine portion 103 such as a carriage motor, a linefeed motor and the like according to a command from CPU100. A detector and/or switch controlling portion 104 sends a signal from various detectors and/or switch 105 to CPU100, and this is transferred to a memory portion 101 under administration of CPU100. A display element controlling portion 106 controls a display panel 107 according to a command from CPU100. An ejection controlling portion 108 controls a recording head 109 according to a command from CPU. CPU100 operates based on data memorized in a memory portion 101, and instructs each controlling portion based on data after operation.

2. Controlling of Ejection of Ink and Treating Liquid

In the present invention, in an FWA-fitted image forming apparatus having high printing speed, a means for minimizing curl and cockle (paper deformation) is introduced in order to improve image quality in double-sided printing. When printing is performed on the back surface of a paper in which curl and cockle has occurred, the distance between the paper and the recording head varies, deteriorating the printing image quality of the back surface. In particular, since the occurrence of curl and cockle greatly influences the amount of water imparted onto a paper, reducing the total amount of ink and treating liquid to be imparted onto the paper and reducing the amount of water to be imparted to the paper is extremely effective for improving image quality (particularly the image quality of the back surface).

In the present invention, in a double-sided printing mode in which printing is performed on both sides of a recording medium, ejection of a treating liquid is controlled by controlling the amount of treating liquid ejected and the ejection region.

In addition, since water contained in an ink has an influence on curl and cockle, it is preferable to also control the ejection of ink. Further, in order to adjust the optical density of the front surface and the back surface, it is favorable to control ejection of the ink.

A specific aspect will be shown below.

Figure 3:
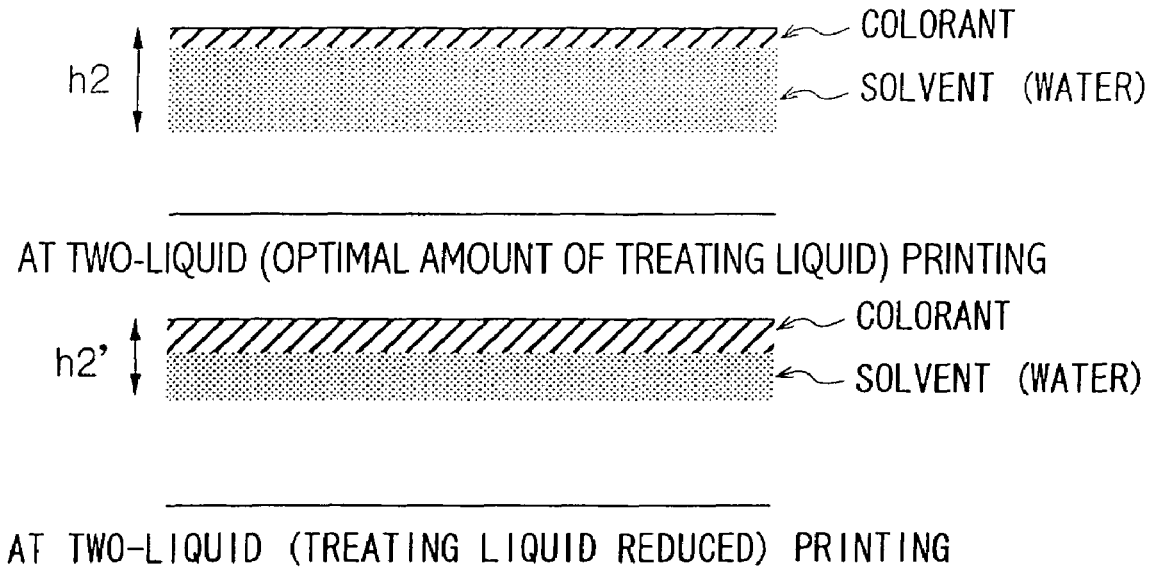
FIG. 3 is a schematic view of a cross-section of a paper after printing on the front surface.

FIG. 3 is a schematic view of a cross-section of a paper after printing on the front surface. In the case of two-liquid printing system, since a colorant is aggregated on surface of a paper, image quality can be improved. However, the amount of water imparted to the paper is further increased by ejection of a treating liquid, and water penetrates into a paper deeper. For this reason, paper deformation such as curl and cockle increases. In FIG. 3, "h2" and "h2'" respectively indicate penetration depths of solvent into the recording medium.

Herein, an optimal amount of a treating liquid to be imparted is determined by an amount of ink to be imparted. Even when a treating liquid is imparted at an amount more than the optimal impartation amount, the effect of aggregating a colorant for an ink remains almost unchanged. Therefore, regarding an impartation amount of a treating liquid, explanation is performed using an "optimal impartation amount".

A first aspect of ejection controlling method is characterized in that, in the double-sided printing mode, an amount of the treating liquid is controlled to a smaller amount than the optimal impartation amount at least on the front surface of a recording medium.

That is, in a first aspect of ejection controlling method, a treating liquid is ejected at an optimal impartation amount in a single-sided printing mode, but a treating liquid is ejected at a smaller amount than the optimal impartation amount on the front surface of recording medium in a double-sided printing mode. Since a treating liquid is imparted at a smaller amount than the optimal impartation amount, an image quality on the front surface is slightly inferior to an image quality in a single-sided printing mode, but since an amount of water imparted to a recording medium (paper) is decreased, paper deformation can be suppressed to be small and, consequently, image quality on the back surface is improved.

Figure 4:
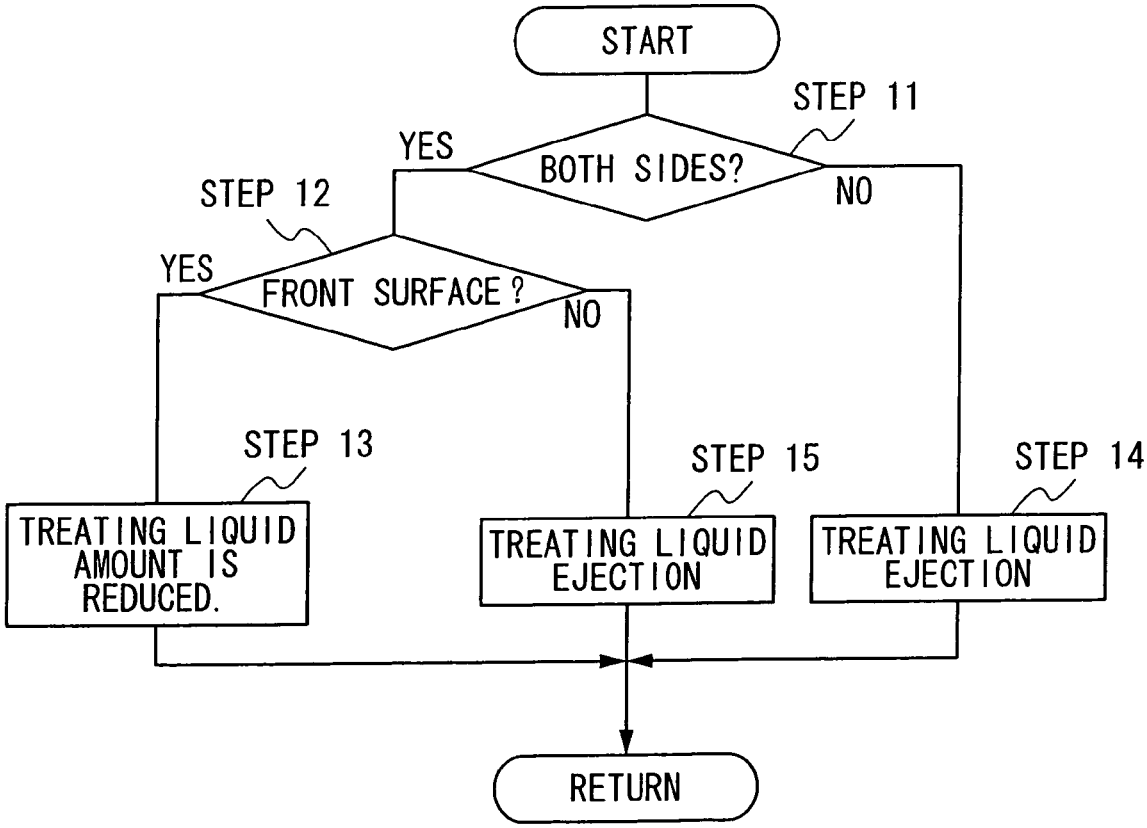
FIG. 4 is a flow chart showing a first aspect of ejection controlling method with regard to the image forming apparatus of the present invention.

FIG. 4 is a flow chart showing a first aspect of ejection controlling method.

In FIG. 4, in a step 11, whether data to be printed is double-sided printing mode or single-sided printing mode is determined. When it is double-sided printing mode, a procedure goes to a step 12 and, when it is single-sided printing mode, a procedure goes to a step 14.

In the step 12, whether a side to be printed is the front surface or the back surface is determined and, when it is the front surface, a procedure goes to a step 13 and, when it is a back surface, a procedure goes to a step 15.

In the step 13, the treating liquid is ejected by reducing an ejection smaller amount than the optimal impartation amount. A preferable ejection amount of the treating liquid to be imparted to the front surface is approximately 10% by mass to approximately 90% by mass, more preferably approximately 30% by mass to approximately 80% by mass, further preferably approximately 50% by mass to approximately 70% by mass based on the optimal impartation amount.

Further, in FIG. 4, in the case of the back surface, a procedure has proceeded from the step 12 to the step 15, it is shown that the treating liquid is imparted at an optimal impartation amount, but an ejection amount of the treating liquid on the back surface may be reduced as in case of the front surface. When an ejection amount of a treating liquid is reduced in a back surface, the amount is preferably approximately 10% by mass to approximately 90% by mass, more preferably approximately 30% by mass to approximately 80% by mass, further preferably approximately 50% by mass to approximately 70% by mass based on the optimal impartation amount.

Figure 5:
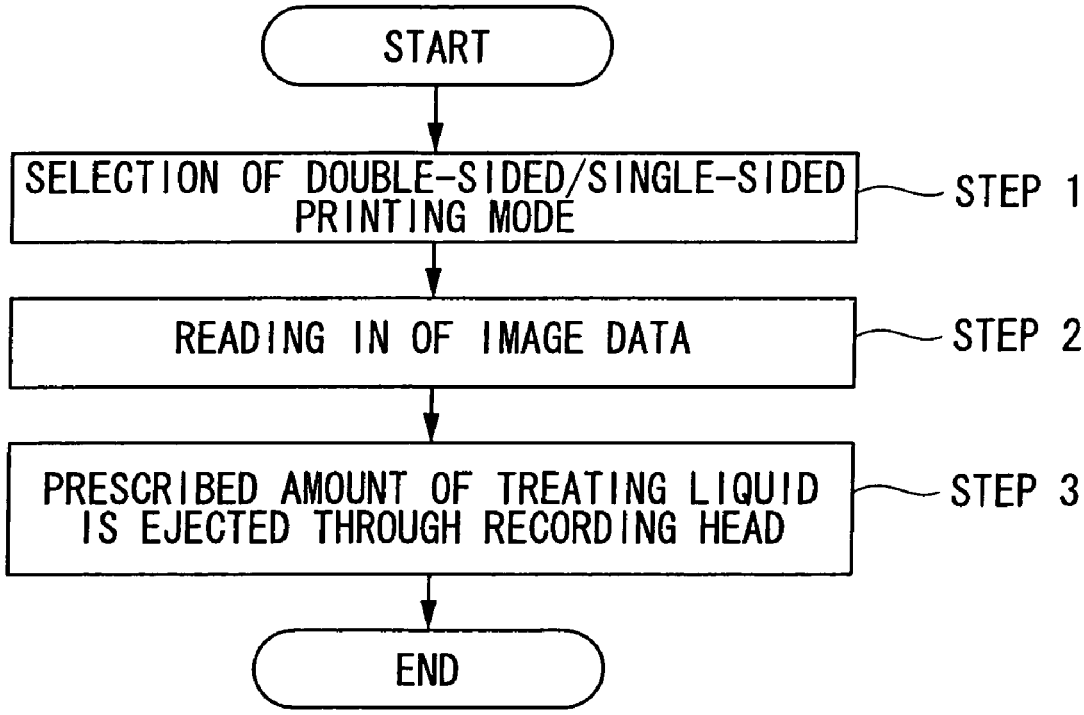
FIG. 5 is a flow chart of a first aspect of ejection controlling method with regard to the image forming apparatus of the present invention.

FIG. 5 is a flow chart for explaining receiving and sending of a signal in a block view shown in FIG. 2, in a first aspect of ejection controlling method.

In a step 1, information on a selection of the double-sided printing mode or the single-sided printing mode is read into a display panel. In a step 2, image data are read therein. In a step 3, based on data of an ejection amount of the treating liquid in the double-sided/single-sided printing mode pre-inputted in the memory part 101, the ejection controlling part 108 controls the recording head 109, and a prescribed amount of the treating liquid is ejected from the memory head 109.

A second aspect of ejection controlling method is characterized in that, in the double-sided printing mode, the treating liquid is ejected to neither the front surface nor the back surface of recording medium.

In the case of single-liquid printing method in which only an ink is imparted and the treating liquid is not imparted, in order that a colorant permeates into the interior of a paper, bleeding is easily caused, and printing quality is slightly lowered. However, since an amount of water imparted to a paper is smaller than in two-liquid printing method, a depth of permeation of water into the interior of a paper becomes small in one-liquid printing method. For this reason, in one-liquid printing method, since paper deformation such as curl and cockle becomes small, a gap variation becomes small between a paper and a recording head during printing on the back surface. Consequently, image quality of the back surface is improved.

Figure 6:
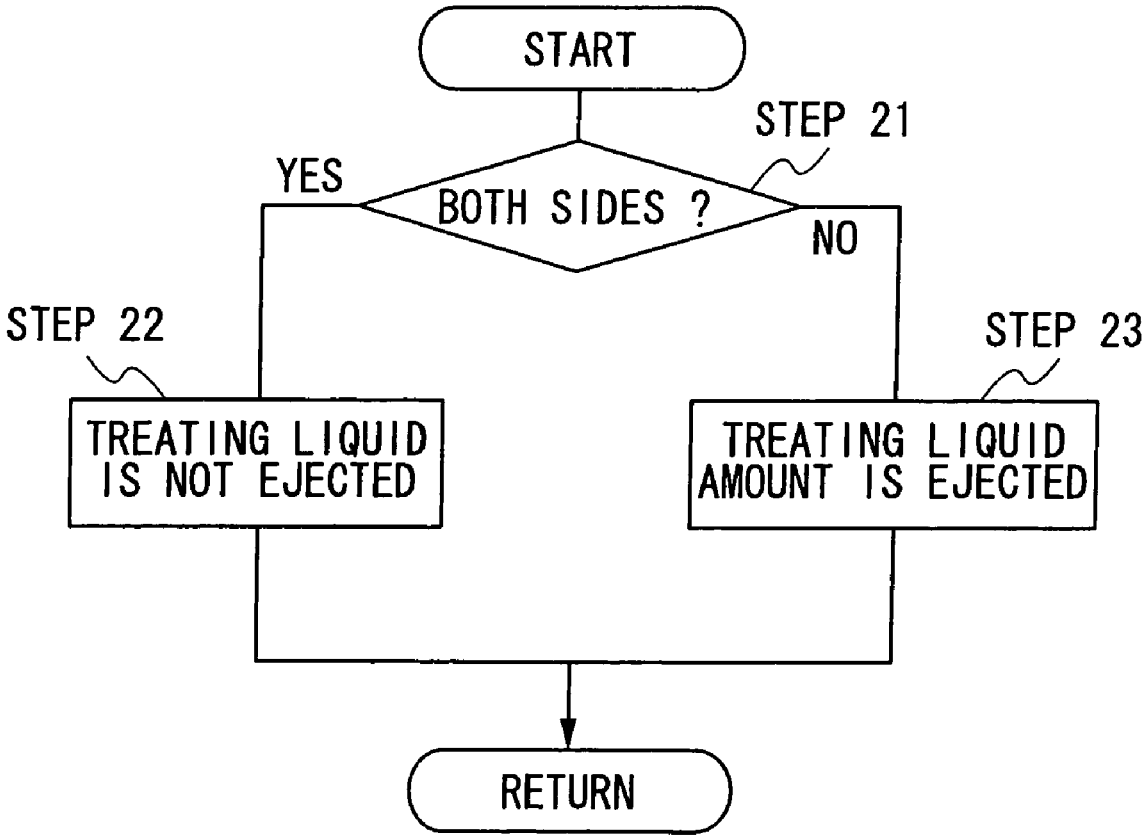
FIG. 6 is a flow chart showing a second aspect of ejection controlling method with regard to the image forming apparatus of the present invention.

FIG. 6 is a flow chart showing a second aspect of ejection controlling method.

In FIG. 6, in a step 21, whether data to be printed is the double-sided printing mode or the single-sided printing mode, is determined. When it is double-sided printing mode, a procedure goes to a step 22 and, when it is single-sided printing mode, a procedure goes to a step 23. In the step 22, the treating liquid is not ejected, and in the step 23, that is, in the single-sided printing mode, the treating liquid is ejected at an optimal impartation amount.

A third aspect of ejection controlling method is characterized in that, in the double-sided printing mode, the treating liquid is ejected to a region of letters and line drawing.

In an image recording apparatus adopting a two-liquid printing method, in particular, the effect of the treating liquid is expected to be improved in the letter quality. There is no bleeding in an outline, and high concentration letter quality is required in office documents. Then, in the double-sided printing mode, the treating liquid is ejected only to the region of letters and line drawing, and the treating liquid is not ejected on the other images. Generally, a ratio of the region occupied by the letters and line drawing is small and, even when the treatment liquid is imparted to such a region, influence on paper deformation is small. Therefore, image quality of the front surface and the back surface is improved.

Since letters and line drawing are frequently delineated with black ink, there is no problem when a treating liquid is ejected only to a region of black ink ejection in place of letters and line drawing.

Figure 7:
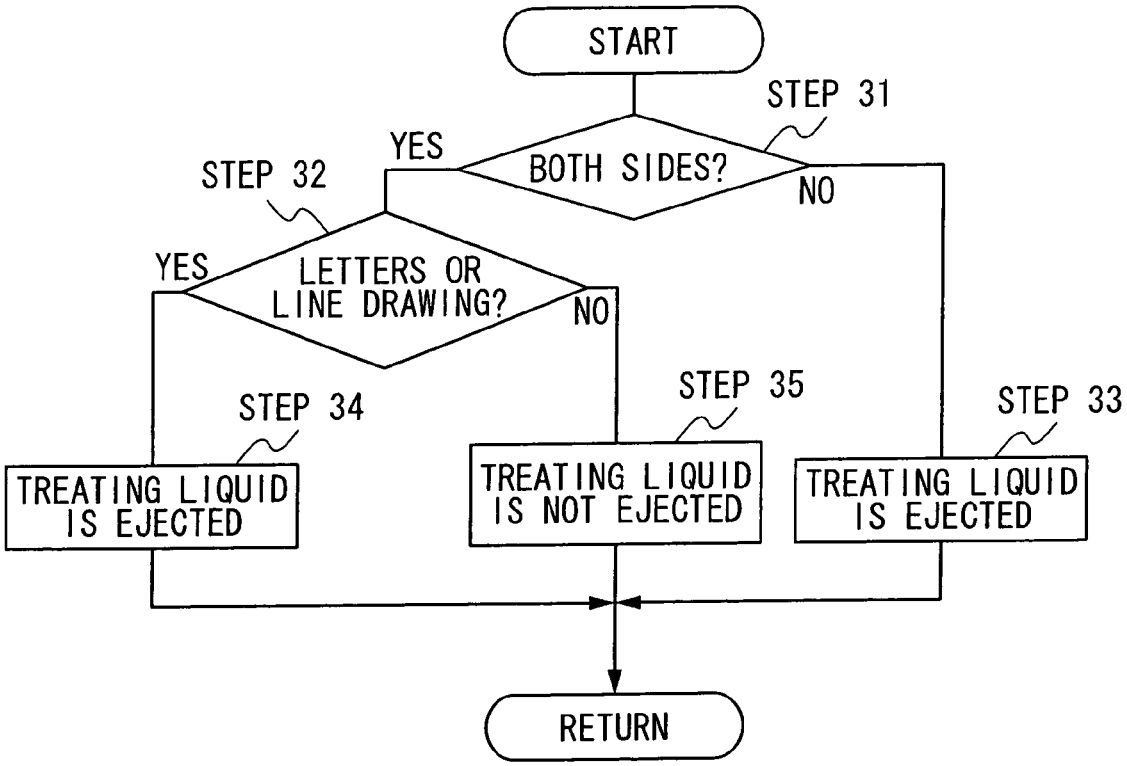
FIG. 7 is a flow chart showing a third aspect of ejection controlling method with regard to the image forming apparatus of the present invention.

FIG. 7 is a flow chart showing a third aspect of ejection controlling method.

In FIG. 7, in a step 31, whether data to be printed is double-sided printing mode or single-sided printing mode is determined. When it is double-sided printing, a procedure goes to a step 32 and, when it is single-sided printing mode, a procedure goes to a step 33. In the step 32, whether data to be printed is letters and line drawing or not is determined. Whether data is letters and line drawing or not is determined by the known means. When it is letters and line drawing, a procedure goes to a step 34 and, otherwise, a procedure goes to a step 35.

In the step 34, a treating liquid is ejected. Thereupon, the ejection controlling portion 108 drives a recording head so as to adjust an ejection position of the treating liquid on the recording medium at the position where letters and line drawing is formed with an ink.

In the step 35, the treating liquid is not ejected.

In FIG. 7, in the step 35, the treating liquid is not ejected, but the treating liquid may be ejected at an ejection smaller amount than the optimal impartation amount. In this case, an ejection amount of the treating liquid is such that the treating liquid is ejected to letters and line drawing at an optimal impartation amount, and the treating liquid is ejected to a region other than letters and line drawing preferably at approximately 10% by mass to approximately 90% by mass, more preferably approximately 30% by mass to approximately 80% by mass, further preferably approximately 50% by mass to approximately 70% by mass based on an optimal impartation amount.

In the step 33, that is, in a single-sided printing mode, a treating liquid is imparted at an optimal impartation amount.

In the step 32 of FIG. 7, whether data to be printed is letters and line drawing or not is determined, but whether it is a black in or not may be determined. In this case, in steps after the step 32, "letters and line drawing" is replaced with a "black ink".

A fourth aspect of ejection controlling method is characterized in that, in a double-sided printing mode, the treating liquid is not ejected on the front surface, and ejection of the ink on the back surface is controlled so that an optical density becomes smaller than an optical density of an image of the front surface, and then ejection of the treating liquid on the back surface is controlled based on the ejection amount of the ink or optical density to be require.

Since the front surface uses one-liquid printing method in which the treating liquid is not ejected and only an ink is ejected, deformation of the paper is small, therefore, a gap variation between the paper and a recording head when the back surface is printed becomes small, and image quality of the back surface is improved.

However, when one-liquid printing method is performed in the front surface, and two-liquid printing method is performed in the back surface, printing concentrations between the front surface and the back surface of the recording medium is different. Then, the ink is ejected so that, by image processing, printing concentrations of the front surface and the back surface become approximately the same, and an optical density on the back surface becomes lower than an optical image density on the front surface.

Image treatment may be performed by a method changing a threshold of a half tone, or a method of directly changing a concentration of image data.

Figure 8:
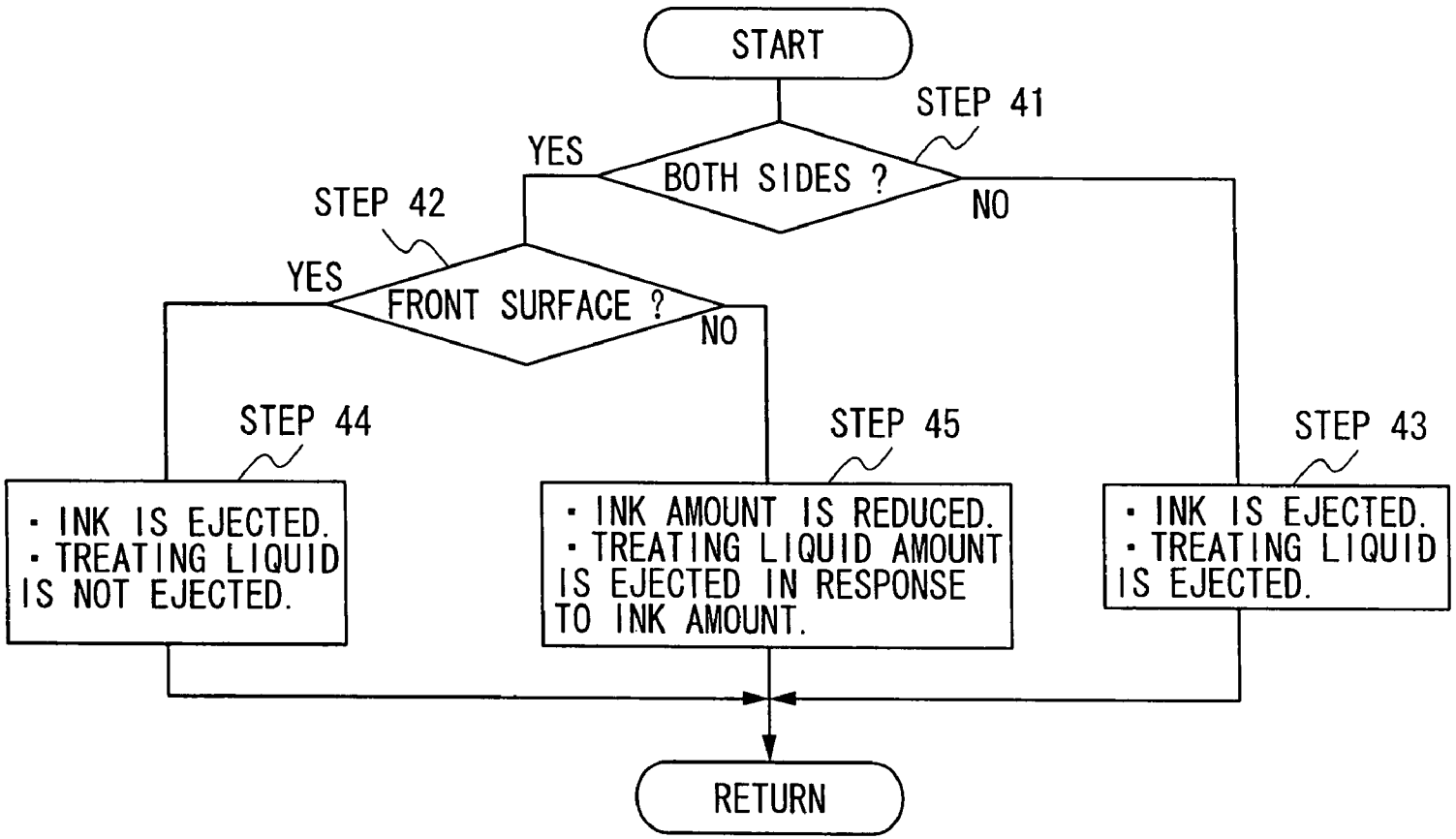
FIG. 8 is a flow chart showing a fourth aspect of ejection controlling method with regard to the image forming apparatus of the present invention.

FIG. 8 is a flow chart showing the fourth aspect of ejection controlling method.

In FIG. 8, in a step 41, whether data to be printed is double-sided printing mode or single-sided printing mode is determined. When it is double-sided printing mode, a procedure goes to a step 42 and, when it is single-sided printing mode, a procedure goes to a step 43. In the step 42, whether printing is performed on a front surface or a back surface is determined. When it is the front surface, a procedure goes to a step 44 and, when it is the back surface, a procedure goes to a step 45.

In the step 44, the treating liquid is not ejected.

In the step 45, the ink is ejected by decreasing an ejection amount, and the treating liquid is ejected at an amount corresponding to such the ejection amount of the ink.

In the step 43, that is, in the single-sided printing mode, the treating liquid is imparted at an optimal impartation amount.

In FIG. 8, in the step 44, the treating liquid is not ejected, but the treating liquid may be ejected by decreasing an ejection amount than the optimal impartation amount, by combining with the aforementioned first aspect of ejection controlling method. The ejection amount of the treating liquid in this case is approximately 10% by mass to approximately 90% by mass, more preferably approximately 30% by mass to 80% by mass, further preferably approximately 50% by mass to approximately 70% by mass relative to an optimal impartation amount.

Herein, regarding an ejection amount of the treating liquid for the back surface, data of the ink amount and the treating liquid amount in two-liquid printing method which is approximately the same as an optical density (optical density in surface) in one-liquid printing method may be inputted in the memory portion 101 in advance, or the optical density at a printing portion on the front surface is detected with the sensor 105, and ejection amounts of the ink and the treating liquid on the back surface may be determined based on data of this optical density.

Figure 9A:
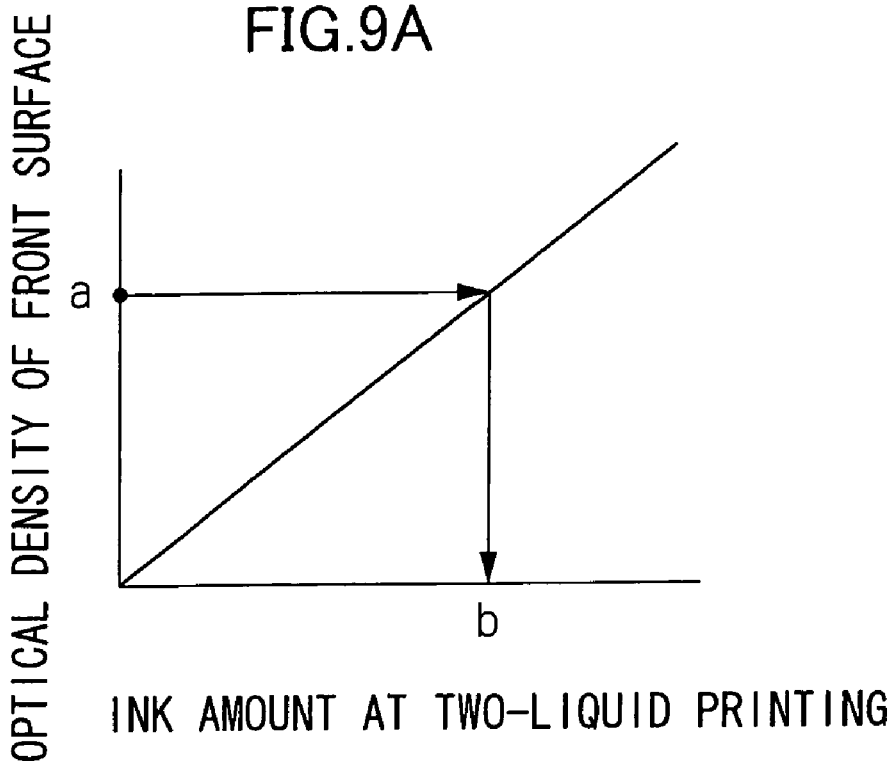
FIGS. 9A and 9B show one example of calibration curve data in the fourth aspect of ejection controlling method.
Figure 9B:
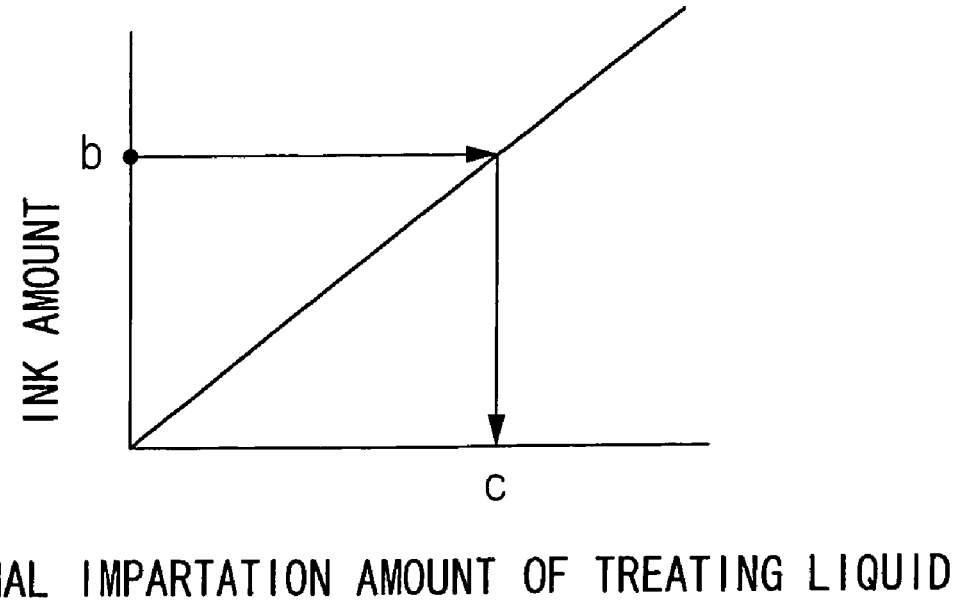

When ejection amounts of the ink and the treating liquid on the back surface are determined using the data of the optical density at the printing portion of the front surface which has been detected, data of a calibration curve shown in FIG. 9(*a*) plotting an ink amount at two-liquid printing method relative to the optical density on the front surface, and a calibration curve shown in FIG. 9(*b*) plotting an optimal treating liquid amount relative to the ink amount are inputted in the memory portion 101, data of the optical density on the front surface which has been detected with the sensor 105, and data of these calibration curves are used to determine ejection amounts of the ink and the treating liquid for the back surface in which optical densities on the front surface and the back surface become approximately the same by CPU 100, and the ink and the treating liquid are ejected to the back surface from the recording head from 109 at calculated ejection amounts of the ink and the treating liquid.

The optical density can be adjusted by a mass of a liquid per drop, and the number of drops per pixel. Therefore, the optical density can be adjusted by the number of drops if the same effect can be obtained, although FIG. 8 is explained that the optical density is adjusted by change in an ink amount.

A fifth aspect of ejection controlling method is characterized in that, in the double-sided printing mode, ejection of ink on the front surface of the recording medium is controlled so that an optical density becomes lower that an optical image density in a single-sided printing mode, and an ejection amount of the treating liquid on the front surface is controlled so than it becomes lower than the optimal impartation amount.

By controlling ejection of the ink and the treating liquid on the front surface, deformation of the paper when the back surface is printed becomes small, a gap variation between the paper and a recording head when the back surface is printed becomes small, and image quality on the back surface is improved The ink and the treating liquid on the back surface are ejected under the same condition as that of the single-sided printing mode. Therefore, when the front surface is drawn by letters and line, and the back surface is drawn by a high quality image such as a photograph, this method is significantly advantageous.

Figure 10:
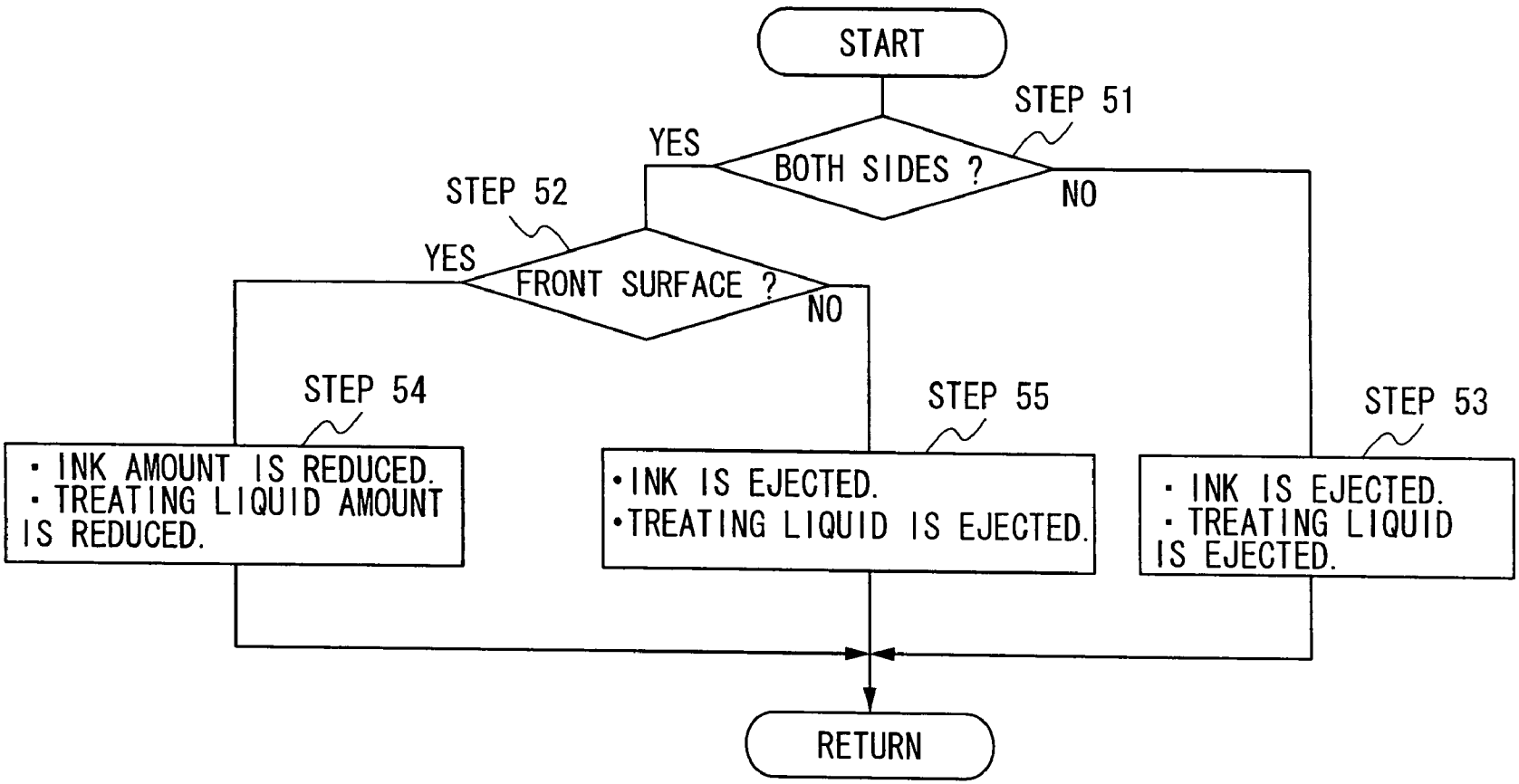
FIG. 10 is a flow chart showing a fifth aspect of ejection controlling method with regard to the image forming apparatus of the present invention.

FIG. 10 is a flow chart showing a fifth aspect of ejection controlling method.

In FIG. 10, in a step 51, whether data to be printed is double-sided printing mode or single-sided printing mode is determined. When it is double-sided printing mode, a procedure goes to a step 52 and, when it is single-sided printing mode, a procedure goes to a step 53.

In the step 52, whether printing is performed on the front surface or the back surface is determined. When it is the front surface, a procedure goes to a step 54 and, when it is the back surface, a procedure goes to a step 55.

In the step 54, an ink is ejected at a smaller amount than an ejection amount of the ink in the single-sided printing mode, and the treating liquid is ejected at a smaller amount than the optimal ejection amount corresponding to a reduced ejection amount of the ink.

The optical image density in the step 54 is preferably approximately 30% to 95%, more preferably approximately 40% to 90%, further preferably approximately 50% to 85% relative to an optical density (100%) in a single-sided printing mode.

The ejection amount of the ink is approximately 30% to 95%, more preferably approximately 40% to 90%, further preferably approximately 50% to 85% relative to a single-sided printing mode (100%).

In addition, an ejection amount of the treating liquid in the step 54 is determined depending on the ejected ink amount. Therefore, the amount is controlled so that it becomes smaller than the optimal impartation amount in a single-sided printing mode Further, an ejection amount of the treating liquid in the step 54 may be decreased than an amount determined corresponding to the amount of the ejected ink.

In FIG. 10, in the step 54, an ejection amount of the treating liquid is simply reduced, but by combining with the aforementioned third aspect of ejection controlling method, the treating liquid may be ejected only to a region of letters and line drawing or a black ink.

In the step 55, that is, in the case of the back surface, since an ejection amount of ink and an ejection amount of an ejection each are the same as an ejection amount of ink and an ejection amount of a treating liquid in a single-sided printing mode, an image of high quality can be obtained.

In the step 53, that is, in the single-sided printing mode, the treating liquid is imparted at an optimal impartation amount.

In a sixth aspect of ejection controlling method, as in the fifth aspect of ejection controlling method, ejection of ink on the front surface of the recording medium is controlled so that an optical density becomes smaller than an optical density of an image in a single-sided printing mode, and an ejection amount of a treating liquid on the front surface is controlled so that the amount becomes smaller than the optimal impartation amount. Further, the method is characterized in that, ejection of the ink on the back surface of a recording medium is controlled so that an optical density on the back surface becomes smaller than an optical density on the front surface, and an ejection amount of the treating liquid on the back surface is controlled so that an amount becomes smaller than the optimal impartation amount.

In both of the front surface and the back surface, since the ink and the treating liquid are ejected at a smaller amount than that of single-sided printing mode, a water amount becomes small, and deformation of the paper becomes small. Therefore, a gap variation between the paper and a recording head becomes small during printing on the back surface, and image quality of the back surface is improved.

Figure 11:
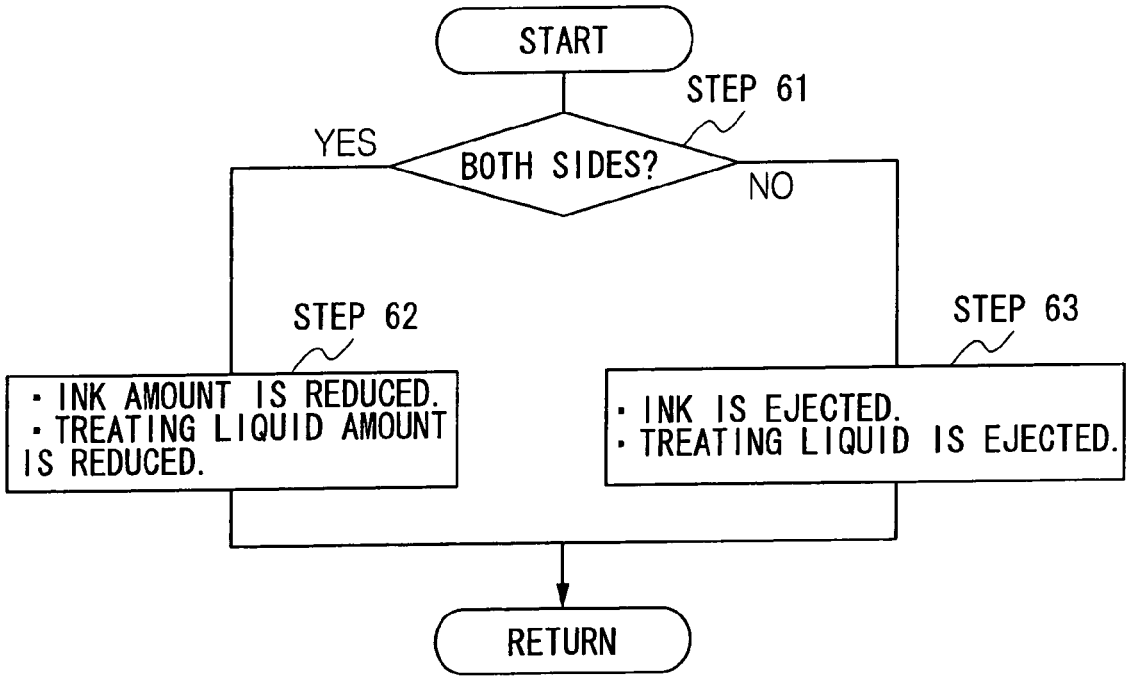
FIG. 11 is a flow chart showing a sixth aspect of ejection controlling method with regard to the image forming apparatus of the present invention.

FIG. 11 is a flow chart showing a sixth aspect of ejection controlling method.

In FIG. 11, in a step 61, whether data to be printed is double-sided printing mode or single-sided printing mode is determined. When it is double-sided printing mode, a procedure goes to a step 62 and, when it is single-sided printing mode, a procedure goes to a step 63.

In the step 62, in both of the front surface and the back surface, the ink is ejected at a smaller amount than an ejection amount of the ink in a single-sided printing mode, and the treating liquid is ejected at an amount corresponding to a reduced ejection of the ink.

The optical density of the image recorded in the step 62 is preferably approximately 30% to 95%, more preferably approximately 40% to 90%, further preferably approximately 50% to 80% relative to an optical density (100%) in a single-sided printing mode.

The ejection amount of the ink is approximately 30% to 95%, more preferably approximately 40% to 90%, further preferably approximately 50% to 85% relative to a single-sided printing mode (100%).

In addition, since an amount of the ejected ink in the step 62 becomes small, an optimal impartation amount of the treating liquid becomes small correspondingly.

Further, the amount may be decreased than the optimal impartation amount (100%) of the treating liquid corresponding to an amount of an ejected ink. In this case, an amount is approximately 10% to 90%, more preferably approximately 30% to 80%, further preferably approximately 50% to 70% of an optimal impartation amount (100%)

In addition, in FIG. 11, in the step 62, an ejection amount of the treating liquid is simply decreased, but by combining with the aforementioned third aspect of ejection controlling method, the treating liquid may be ejected only to a region of letters and line drawing or a black ink.

In the step 63, that is, in the single-sided printing mode, the treating liquid is imparted at an optimal impartation amount.

A seventh aspect of ejection controlling method is characterized in that, in a double-sided printing mode, the treating liquid is not imparted to a region in which ejection of ink is overlapped between the front surface and the back surface, or an amount of the treating liquid to be imparted to the region is controlled, based on image information.

Figure 12:
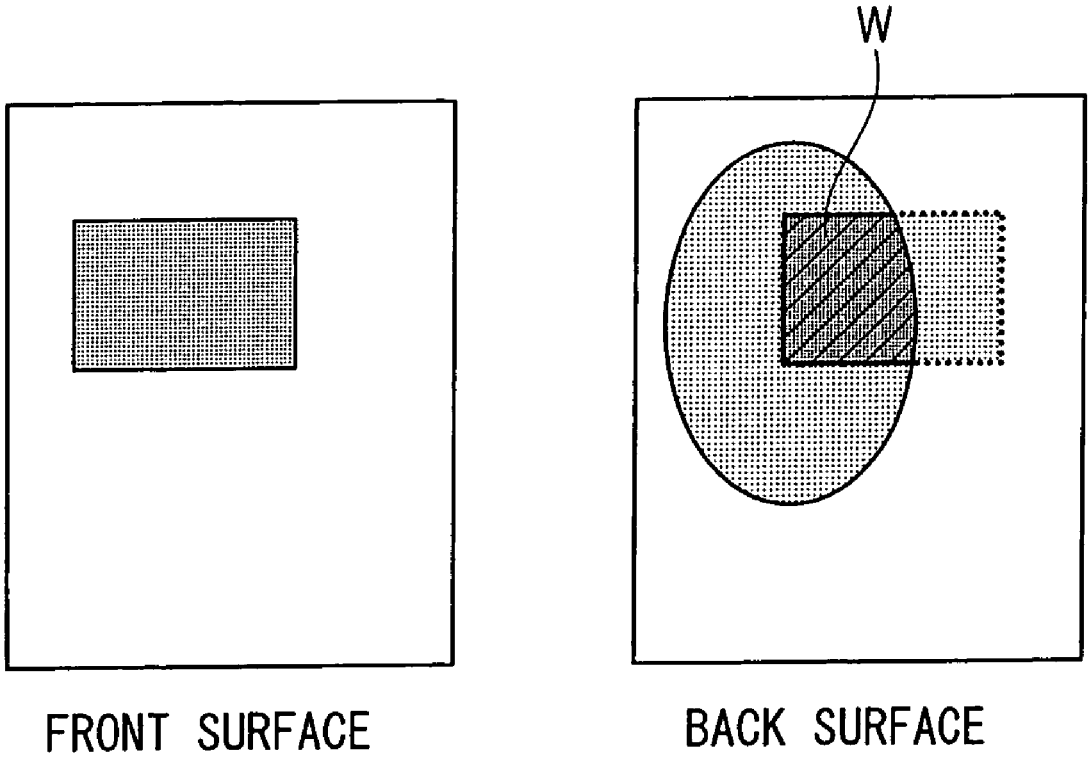
FIG. 12 illustrates the appearance of images printed on a front surface and a back surface.

FIG. 12 illustrates an appearance printing on the front surface and the back surface. At a portion W where an ejection region is overlapped between the surface and the back surface (hereinafter, referred to as "overlapped portion"), an amount of water to be imparted becomes large, extremely greatly influencing on drying property and deformation of a paper.

Then, at an overlapped portion, the treating liquid is not ejected, or an ejection amount of the treating liquid is decreased. In this method, at a region other than the overlapped portion, the treating liquid is ejected, in result, show-through is caused with difficulty. Since show-through is remarkable particularly at the portion having no image, and is not so remarkable at a portion having image, this method is effective also regarding show-through.

Figure 13:
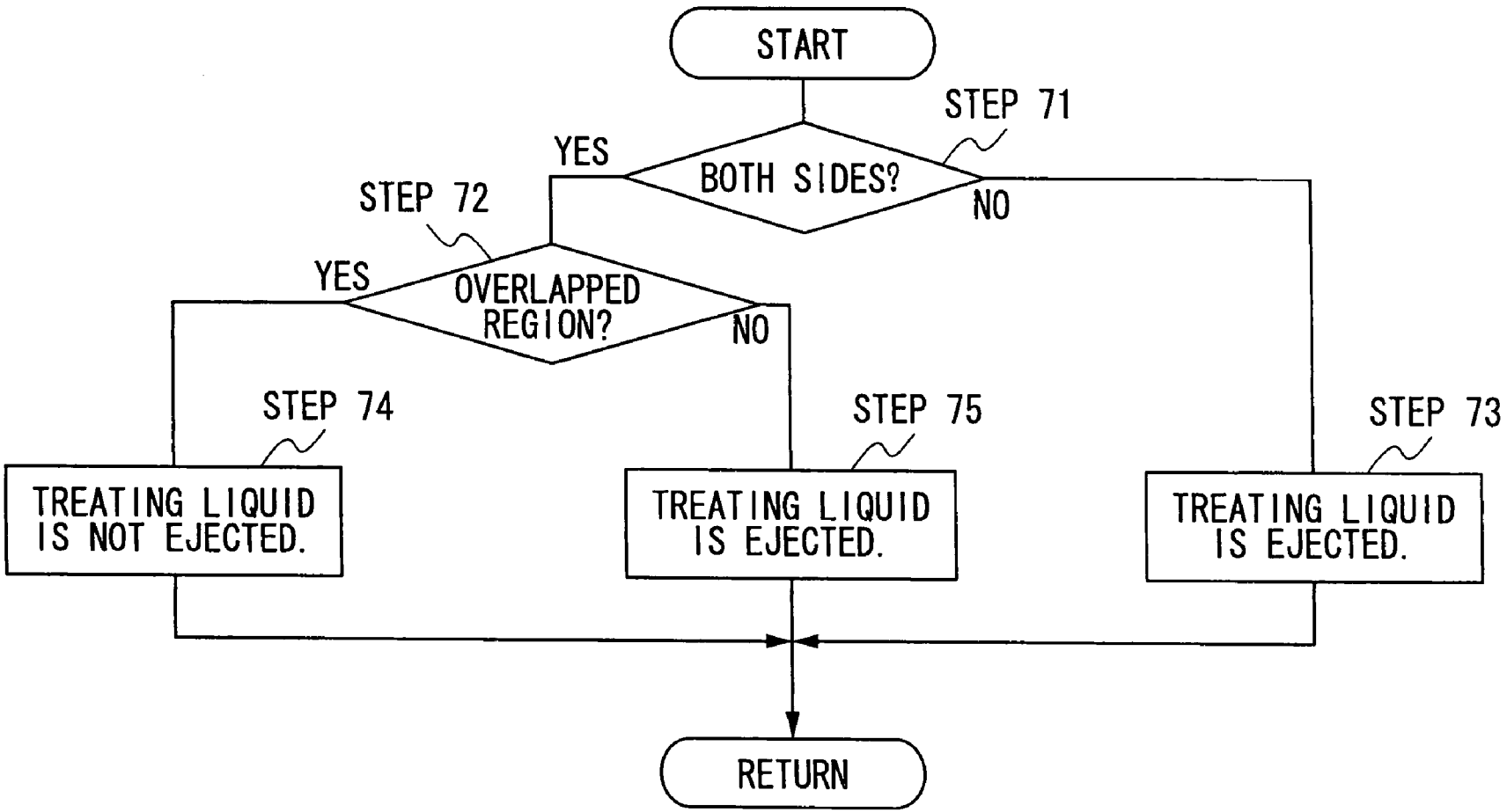
FIG. 13 is a flow chart showing a seventh aspect of ejection controlling method with regard to the image forming apparatus of the present invention.

FIG. 13 is a flow chart showing a seventh aspect of ejection controlling method.

In FIG. 13, in a step 71, whether data to be printed is double-sided printing mode or single-sided printing mode is determined. When it is double-sided printing mode, a procedure goes to a step 72 and, when it is single-sided printing mode, a procedure goes to a step 73. In the step 72, whether an overlapped portion is printed or not is determined. When the overlapped portion is printed, a procedure goes to a step 74 and, when other region is printed, a procedure goes to a step 75.

In the step 74, a treating liquid is not ejected, or an ejection amount of the treating liquid is reduced. In the step 74, when an ejection amount of the treating liquid is reduced, the ejection amount is approximately 10% by mass to approximately 90% by mass, more preferably approximately 30% by mass to approximately 80% by mass, further preferably approximately 50% by mass to approximately 70% by mass based on an optimal impartation amount. When the ejection amount of the treating liquid is reduced, the treating liquid may be ejected only to a region of letters and line drawing or a black ink as in the aforementioned third aspect of election controlling method.

In the step 75, the treating liquid is ejected at the same ejection amount as that of the single-sided printing mode.

In the step 73, that is, in the single-sided printing mode, the treating liquid is imparted at the optimal impartation amount.

Figure 14:
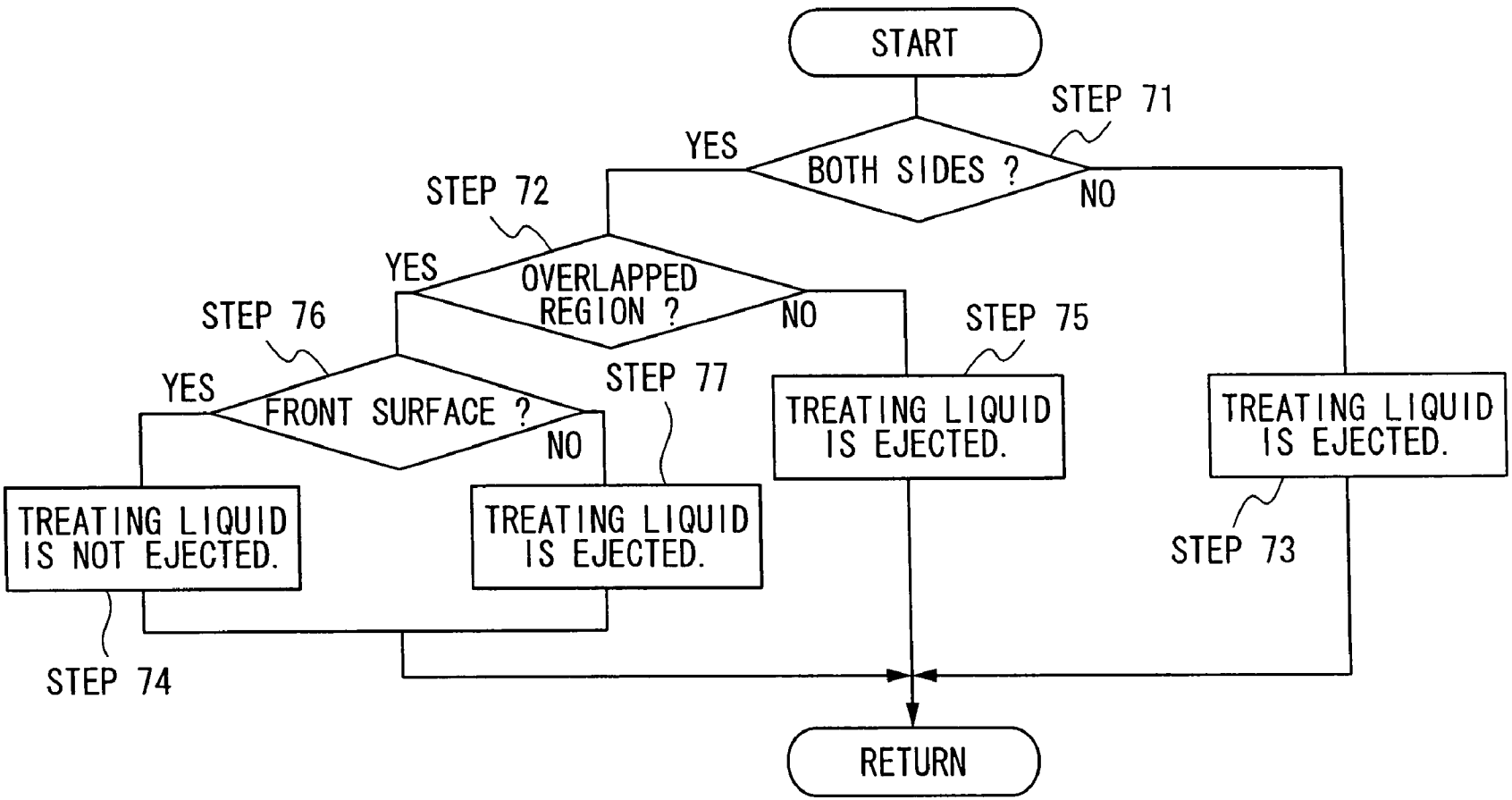
FIG. 14 is another flow chart in a seventh aspect of ejection controlling method with regard to the image forming apparatus of the present invention.

In addition, in the seventh aspect of ejection controlling method, as in a flow chart shown in FIG. 14, at the overlapped portion W, the treating liquid may be not ejected or the treating liquid may be ejected at a reduced ejection amount only in the front surface, and the treating liquid on the back surface may be ejected at an optimal impartation amount. Further, at an overlapped portion of the back surface, the ejection amount of the treating liquid is not only an optimal impartation amount, but also the treating liquid may be imparted at approximately 10% by mass to approximately 90% by mass, more preferably approximately 30% by mass to approximately 80% by mass, further preferably approximately 50% by mass to approximately 70% by mass based on an optimal impartation amount.

An eighth aspect of ejection controlling method is the case where a single-sided coated paper having a coated surface is used as the recording medium, and is characterized in that, in a double-sided printing mode, the treating liquid is not ejected to a coated side (surface), and ejection of the ink is controlled so that an optical density becomes approximately the same as an optical density of an image of the coated surface, and ejection of the treating liquid on a non-coated side (back surface) is controlled In the coated side, since coating is performed so that aggregation of ink is caused, image quality is better even when the treating liquid is not imparted. Therefore, first, printing is performed on the coated side without ejecting the treating liquid, next, printing is performed on a non-coated (the back surface) with the treating liquid In the front surface (coated side), since the treating liquid is not imparted, deformation of a paper is small, a gap variation between the paper and a recording head in back surface printing becomes small and, consequently, image quality of the back surface is improved. In addition, image quality on the surface (coated side) is also better.

Between an image in one-liquid printing method on a coated side and an image obtained by two-liquid printing method on a non-coated side, each printing concentration is different in some cases. Therefore, an ink is ejected by controlling an optical image density by image processing in the back surface so that printing concentrations on the front surface and the back surface become approximately the same. Image processing can be used a method of changing a threshold of half tone, a method of directly changing a concentration of image data, and the like.

Figure 15:
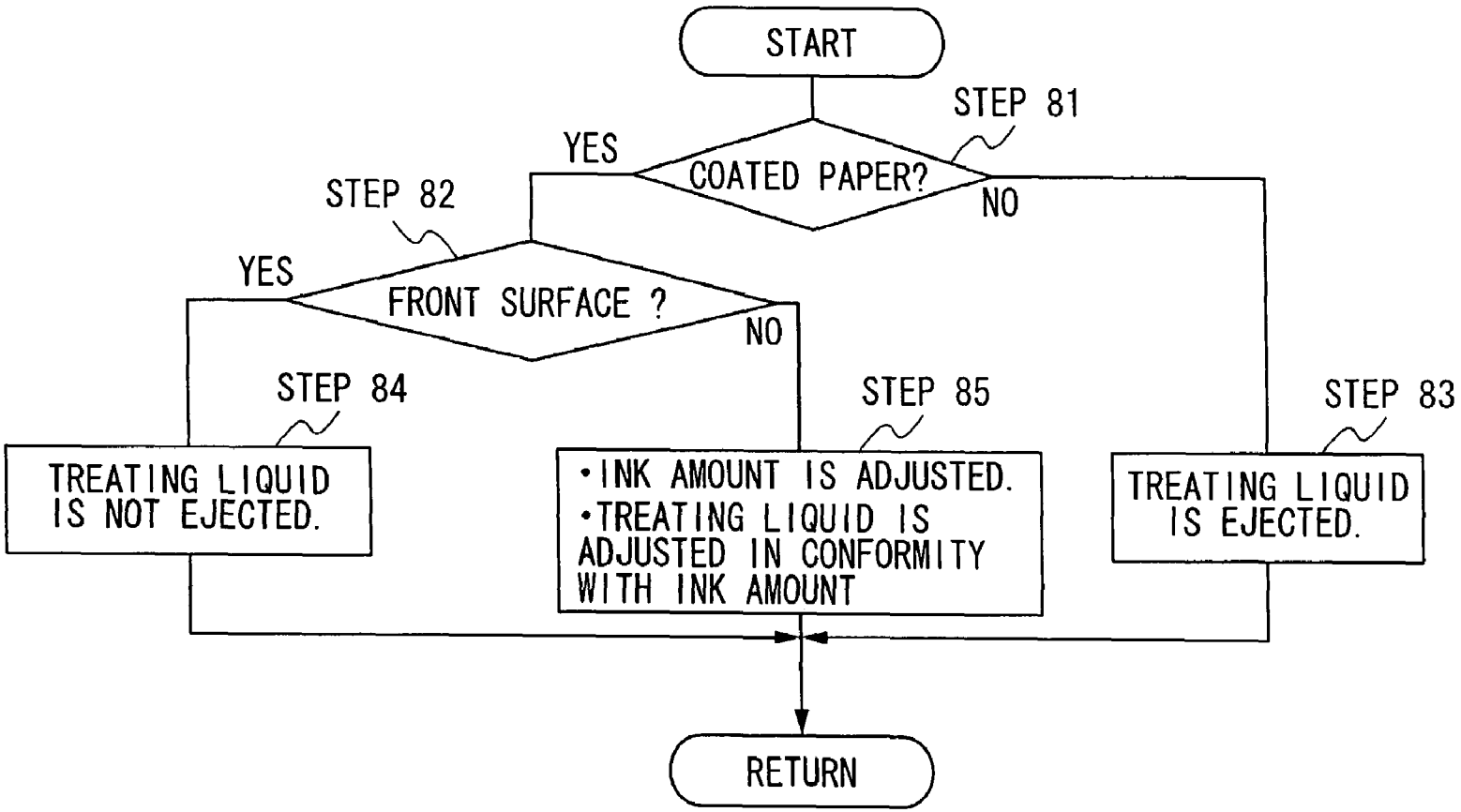
FIG. 15 is a flow chart showing an eighth aspect of ejection controlling method with regard to the image forming apparatus of the present invention.

FIG. 15 is a flow chart showing an eighth aspect of ejection controlling method.

In FIG. 15, in a step 81, whether a recording medium is a coated paper or a non-coated paper is determined. When it is the coated paper, a procedure goes to a step 82 and, when it is the non-coated paper, a procedure goes to a step 83. In the step 82, whether a coated side (surface) or a non-coated side (back surface) is printed is determined. When the coated side is printed, a procedure goes to a step 84 and, when the non-coated side is printed, a procedure goes to step 85.

In the step 84, a treating liquid is not ejected.

In the step 85, the ink and the treating liquid are ejected so that an optical density becomes approximately the same as an optical density of an image on the coated side. An image processing method of rendering optical densities approximately the same is as in the aforementioned fourth aspect of ejection method.

In the step 83, that is, in the non-coated paper, when double-sided printing is performed mode, the aforementioned first to seventh aspect of ejection controlling methods are applied.

The first to eighth aspect of ejection controlling methods have been explained and, in these methods, paper deformation such as curl and cockle is suppressed by controlling the treating liquid, the ejection amount of ink, and the ejection region. In addition to them, it is also preferable to control an ejection time (timing) of the treating liquid and the ink.

The first to eighth aspect of ejection controlling methods have been explained using an ejection amount of the treating liquid in a single-sided printing mode as an optimal impartation amount, but when the treating liquid in the single-sided printing mode is ejected at an amount different from the optimal impartation amount as an ejection amount, the aforementioned first to eighth aspect of ejection controlling methods are applied by replacing the "optimal impartation amount" with an "ejection amount in a single-sided printing mode".

In the aforementioned ejection controlling method, when the ink and the treating liquid are contacted, they may be imparted so that they are adjacent to each other, or they may be imparted so that one covers the other.

As an order of imparting the ink and the treating liquid to the recording medium, it is better that after the treating liquid is imparted, the ink is imparted because, by imparting the treating liquid first, it becomes possible to effectively aggregate and/or insolubilize components constituting the ink. After the treating liquid is imparted, the ink may be imparted at any time, but the ink is imparted preferably in one second, more preferably in 0.5 second after impartation of the treating liquid.

In both of the ink and the treating liquid, the liquid mass per drop is preferably approximately 25 ng or less, more preferably not less than approximately 0.5 ng and not more than approximately 20 ng, further preferably not less than approximately 2 ng and not more than approximately 8 ng. When the liquid mass per drop exceeds approximately 25 ng, bleeding is deteriorated in some cases. It is thought that this is due to change in a contact angle of the ink and the treating liquid relative to a recording medium depending on a drop amount, and there is a tendency that as a drop amount is increased, a drop is easily spread in a paper surface direction. However, when it is possible to spray a plurality of volumes of drops through one nozzle, a drop amount refers to a drop amount of a printable of minimum drop.

A mass ratio of the ink impartation amount and the treating liquid impartation as an amount required for one pixel is preferably approximately 1:20 to 20:1, more preferably approximately 1:10 to 10:1, further preferably approximately 1:5 to 5:1. When the ink impartation amount is too small or too large relative to the treating liquid impartation amount, the action of aggregating and/or insolubilizing ink components becomes insufficient, and reduction in an optical density, deterioration of bleeding, and deterioration of bleeding between colors are caused in some cases. Herein, a pixel is a lattice point constituted when a desired image is divided by the ink impartable minimum distance in a main scanning direction and a minor scanning direction. By imparting a suitable ink to each pixel, a color and an image concentration are adjusted, and the image is formed.

3. Ink

Details of ink which can be used in the image recording apparatus of the present invention will be explained.

An ink used in the present invention contains at least a coloring agent (colorant) and, usually, contains a water-soluble solvent and water. These respective components is explained in detail.

3-1. Coloring Agent

A coloring agent used in an ink may be either a dye or a pigment and, in particular, a pigment is preferable because it is thought that aggregation is easily caused at mixing with a treating liquid in the case of a pigment as compared with a dye. Among the pigment, a pigment which is dispersed with a polymer dispersant (polymer material described later), a self-dispersible pigment, a pigment covered with a resin and a polymer-grafted pigment are preferable.

As a pigment used in the present invention, any of an organic pigment and an inorganic pigment can be used, and examples of a black pigment include a carbon black pigments such as furnace black, lamp black, acetylene black, and channel black. In addition to a black pigment, as well as three primary color pigments of cyan, magenta and yellow, a particular color pigment such as red, green, blue, brown and white, metal luster pigments such as gold and silver, a colorless or pail color loading pigment, and a plastic pigment may be used. In addition to particles in which a dye or a pigment is adhered to a surface of a core of silica, alumina or polymer bead, an insoluble lake of a dye, a colored emulsion, and a colored latex may be also used as a pigment. Further, a pigment which has been newly synthesized for the present invention may be used.

Examples of a black pigment used in the present invention are not limited but include Raven7000, Raven5750, Raven5250, Raven5000 ULTRAII, Raven3500, Raven2000, Raven1500, Raven1250, Raven1200, Raven1190 ULTRAII, Raven1170, Raven1255, Raven1080, and Raven1060 (all are manufactured by Colombian carbon), an Regal1400R, Regal330R, Regal660R, Mogul L, Black Pearls L, Monarch 700, Monarch 800, Monarch 880, Monarch900, Monarch1000, Monarch1100, Monarch1300, and Monarch1400 (all are manufactured by Cabbot), Color Black FW1, Color Black FW2, Color Black FW2V, Color Black 18, Color Black FW200, Color Black S150, Color Black S160, Color Black S170, Printex35, PrintexU, PrintexV, Printex140U, Printex140V, Special Black6, Special Black5, Special Black4A, and Special Black4 (all Degussa), and No.25, No.33, No.40, No.47, No.52, No.900, No.2300, MCF-88, MA600. MA7, MA8, and MA100 (all manufactured by Mitsubishi Chemical Co., Ltd.).

Examples of a cyan pigment are not limited to but include C.I. Pigment Blue -1, -2, -3, -15, -15:1, -15:2, -15:3, -15:4, -16, -22, and -60.

Examples of magenta pigment are not limited to but include C.I. Pigment Red -5, -7, -12, -48, -48:1, -57, -112, -122, -123, -146, -168, -184, and -202.

Examples of yellow pigment are not limited to but include C.I. Pigment Yellow -1, -2, -3, -12, -13, -14, -16, -17, -73, -74, -75, -83, -93, -95, -97, -98, -114, -128, -129, -138, -151, -154, and -180.

A pigment, which is self-dispersible in water, used in the present invention refers to a pigment which has many solubilized groups in water on a pigment surface, and is stably dispersed in water without using a polymer dispersant. Specifically, a pigment self-dispersed in water is obtained by subjecting a conventional so-called pigment to surface modifying treatment such as acid/base treatment, coupling agent treatment, polymer graft treatment, plasma treatment, oxidation/reduction treatment, and the like. In addition, as the pigment self-dispersible in water, the aforementioned pigments, which have been subjected to surface modifying treatment, commercially available self-dispersible pigments such as Cab-o-jet-200, Cab-o-jet-250, Cab-o-jet-260, Cab-o-jet-270, Cab-o-jet-300, IJX-444, and IJX-55 manufactured by Cabbot, and Microjet Black CW-1, and CW-2 manufactured by Orient Chemical Industries, Ltd. can be also used.

A pigment, which is a coloring agent used in an ink and is a self-dispersible pigment, preferably has a carboxylic acid group as a functional group on its surface. It is presumed that since a carboxylic acid group has a small dissociation level, a sufficient aggregating force is easily obtained.

In addition, when a coloring agent used in an ink has sulfonic acid group on its surface, it is preferable to use a polymer compound having a carboxylic acid, in addition to this coloring agent. Since a coloring agent having sulfonic acid group on a surface is aggregated with difficulty, an optical density, bleeding, and bleeding between colors are not improved in some cases. On the other hand, when a coloring agent and a polymer compound having a carboxylic acid group are used jointly, a polymer compound having a carboxylic acid group is insolubilized upon mixing of ink and a treating liquid. It is presumed that thereupon, since a coloring agent is aggregated by incorporation into a polymer compound, an optical density, bleeding, and bleeding between colors are improved.

And, as a coloring agent used in an ink, a pigment covered with a resin can be also used. This is called microcapsule pigment and not only commercially available microcapsule pigments manufactured by Dainippon Ink and Chemicals, Incorporated and Toyo Ink MFG. Co., Ltd., but also microcapsule pigments which have been experimentally manufactured for the present invention can be used.

Further, in the present invention, a polymer-grafted pigment can be also used in a pigment as a coloring agent used for an ink. A polymer-grafted pigment refers to a pigment in which an organic compound such as a polymer is chemically bound to a pigment surface.

On the other hand, a dye used in the present invention may be any of a water-soluble dye and a disperse dye Examples of a water-soluble dye include C.I. Direct Black -2, -4, -9, -11, -17, -19, -22, -32, -80, -151, -154, -168, -171, -194, -195, C.I. Direct Blue -1, -2, -6, -8, -22, -34, -70, -71, -76, -78, -86, -112, -142, -165, -199, -200, -201, -202, -203, -207, -218, -236, -287, -307, C.I. Direct Red -1, -2, -4, -8, -9, -11, -13, -15, -20, -28, -31, -33, -37, -39, -51, -59, -62, -63, -73, -75, -80, 81, -83, -87, -90, -94, -95, -99, -101, -110, -189, -227, C.I. Direct Yellow -1, -2, -4, -8, -11, -12, -26, -27, -28, -33, -34, -41, -44, -48, -58, -86, -87, -88, -132, -135, -142, -144, -173, C.I. Food Black -1, -2, C.I. Acid Black -1, -2, -7, -16, -24, -26, -28, -31, -48, -52, -63, -107, -112, -118, -119, -121, -156, -172, -194, -208, C.I. Acid Blue -1, -7, -9, -15, -22, -23, -27, -29, -40, -43, -55, -59, -62, -78, -80, -81, -83, -90, -102, -104, -111, -185, -249, -254, C.I. Acid Red -1, -4, -8, -13, -14, -15, -18, -21, -26, -35, -37, -52, -110, -144, -180, -249, -257, -289, C.I. Acid Yellow -1, -3, -4, -7, -11, -12, -13, -14, -18, -19, -23, -25, -34, -38, -41, -42, -44, -53, -55, -61, -71, -76, -78, -79, -122.

Examples of a disperse dye include C.I. Disperse Yellow -3, -5, -7, -8, -42, -54, -64, -79, -82, -83, -93, -100, -119, -122, -126, -160, -184:1, -186, -198, -204, -224, C.I. Disperse Orange -13, -29, -31:1, -33, -49, -54, -66, -73, -119, -163, C.I. Disperse Red -1, -4, -11, -17, -19, -54, -60, -72, -73, -86, -92, -93, -126, -127, -135, -145, -154, -164, -167; 1, -177, -181, -207, -239, -240, -258, -278, -283, -311, -343, -348, -356, -362, C.I. Disperse Violet -33, C.I. Diseprse Blue -14, -26, -56, -60, -73, -87, -128, -143, -154, -165, -165:1, -176, -183, -185, -201, -214, -224, -257, -287, -354, -365, -368, C.I. Disperse Green -6:1, -9.

A volume average particle diameter of coloring agent particles in an ink is preferably not less than approximately 30 nm and not more than 250 nm. A volume average particle diameter of coloring agent particles refers to a particle diameter of a coloring agent. When an additive such as a dispersant is adhered to a coloring agent, the volume average particle diameter of coloring agent particles refers to a particle diameter in the state where an additive is adhered. In the present invention, as an apparatus for measuring a volume average particle diameter, Microtrack UPA particle size analyzing apparatus (Leeds & Northrup) is used. Specifically, 4 ml of ink is placed into a measuring cell, and a diameter is measured according to a prescribed method. As a parameter to be inputted at measurement, a viscosity of ink is used as a viscosity, and a coloring agent density is used as a density of dispersed particles.

A volume average particle diameter is more preferably not less than approximately 50 nm and not more than 200 nm, further preferably not less than approximately 75 nm and not more than 175 nm. When a volume average particle diameter of coloring agent particles in an ink is less than approximately 30 nm, a particle concentration is lowered in some cases. On the other hand, when the diameter exceeds approximately 250 nm, storage stability can not be maintained in some cases.

A coloring agent in the present invention is used in a range of preferably not less than approximately 0.1% by mass and not more than 20% by mass, more preferably not less than approximately 1% by mass and not more than 10% by mass relative to a total mass of ink. When an amount of a coloring agent in an ink is less than approximately 0.1% by mass, a sufficient optical density is not obtained in some cases, When an amount of a coloring agent is more than approximately 20% by mass, spraying property of ink is destabilized.

3-2. Polymer Material

In an ink in the present invention, it is preferable to use a polymer material in order to disperse the coloring agent, or as an aggregation promoter for a coloring agent. And in the present invention, a polymer material which is used for dispersion of a coloring agent (pigment) is referred to as a polymer dispersant.

As a polymer material used herein, any of a water-soluble polymer material, and a water-insoluble polymer material such as an emulsion, and self-dispersible fine particles can be used, and the polymer material may be any of a nonionic compound, anionic compound, a cationic compound, and an amphoteric compound.

A polymer substance in an ink has the effect of increasing a viscosity or being aggregated with an aggregating agent contained in a treating liquid, and it is presumed that since a polymer material takes a coloring agent therein upon aggregation and, as a result, there is the effect of increasing an aggregation rate of a coloring agent. That is, a size of a structure, a density of a structure, and easiness of incorporation of a coloring agent into a polymer material upon aggregation of a polymer material become important to increase the aggregation rate. By selecting a coloring agent and a polymer material in an ink, and an aggregating agent in a treating liquid so that a combination of them is optimized, and an optical density, bleeding, and bleeding between colors are improved.

In the present invention, it is preferable that a compound containing a carboxylic acid group is used as a polymer material. It is presumed that since a dissociation level of a carboxylic acid group is small, aggregation with an aggregating agent is promoted.

A specific example of a polymer material used in the present invention will be explained.

Specifically, examples of a polymer material include a copolymer of a monomer having a α,β-ethylenic unsaturated group Examples of the monomer having an α,β-ethylenic unsaturated group include acrylic acid, methacrylic acid, crotonic acid, itaconic acid, itaconic acid monoester, maleic acid, maleic acid monoester, fumaric acid, fumaric acid monoester, vinylsulfonic acid, sutyrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycol dimethacrylate, styrene derivative such as styrene, α-methylstyrene, and vinyltoluene, vinylcyclohexane, vinylnaphthalene, vinylnaphthalene derivative, acrylic acid alkyl ester, acrylic acid phenyl ester, methacrylic acid alkyl ester, methacrylic acid phenyl ester, methacrylic acid cycloalkyl ester, crotonic acid alkyl ester, itaconic acid dialkyl ester, and maleic acid dialkyl ester.

A copolymer obtained by copolymerizing the monomer having an α,β-ethylenic unsaturated group alone or a plurality of the monomers is suitably used as a polymer material in the present invention. Specifically, examples of this copolymer is styrene-styrenesulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an acrylic acid alkyl ester-acrylic acid copolymer, a methacrylic acid alkyl ester-methacrylic acid, a styrene-methacrylic acid alkyl ester-methacrylic acid copolymer, a styrene-acrylic acid alkyl ester-acrylic acid copolymer, a styrene-methacrylic acid phenyl ester-methacrylic acid copolymer, and a styrene-methacrylic acid cyclohexyl ester-methacrylic acid copolymer.

These polymer materials are selected preferably by taking affinity for a coloring agent (pigment) and aggregating property of a polymer material itself into consideration. Specifically, it is preferable to use a polymer material having an acid value of not less than approximately 30 KOHmg/g and less than 150 KOHm/g, or an acid value of not less than approximately 150 KOHmg/g and a neutralization level of not more than approximately 80%.

When an acid value of a polymer compound is not less than approximately 30 KOHmg/g and less than 150 KOHmg/g, an acid value is more preferably approximately 50 to 120 KOHmg/g, further preferably approximately 70 to 120 KOHmg/g. When an acid value is less than approximately 30 KOHmg/g, spraying (ejection) stability of ink is reduced in some cases.

On the other hand, when an acid value of a polymer compound is not less than approximately 150 KOHmg/g and neutralization level is not more than approximately 80%, more preferably, an acid value is approximately 200 to 400 KOHmg/g and a neutralization is approximately 50 to 80%, further preferably, an acid value is approximately 200 to 300 KOHmg/g and a neutralization level is approximately 60 to 80%. When an acid value exceeds approximately 400 KOHmg/g, and a neutralization level exceeds approximately 80%, a viscosity of ink is increased, and an ink can not be normally sprayed in some cases.

It is considered that like this, by using a polymer material having a low acid value or a polymer material having a high acid value under condition of a low polymerization level, thereby it becomes possible to reduce an amount of a water-soluble group of a polymer material and, even when an aggregating agent having a weak aggregating force is used in a treating liquid, it becomes possible to obtain a sufficiently great aggregating force.

A weight average molecular weight of a polymer material used in the present invention is in a range of more preferably approximately 2,000 to 15,000, further preferably approximately 3,500 to 10,000. When a weight average molecular weight of a polymer material is less than approximately 2,000, a pigment is not stably dispersed in some cases. On the other hand, when a molecular weight exceeds approximately 15,000, a viscosity of a liquid is increased and ejecting property is deteriorated in some cases.

A polymer material to be added to an ink is added preferably in a range of not less than approximately 0.01% by mass and not more than 10% by mass, more preferably in a range of not less than approximately 0.05% by mass and not more than 7.5% by mass, further preferably in a range of not less than approximately 0.1% by mass and not more than 5% by mass relative to a total mass of ink. When an addition amount exceeds approximately 10% by mass a liquid viscosity increased, and spraying property of a liquid becomes unstable in some cases. On the other hand, when an addition amount is less than approximately 0.01% by mass, dispersion stability of a pigment is reduced in some cases.

3-3. Water-Soluble Solvent

As a water-soluble solvent used in an ink, a solvent which is dissolved in water at approximately 0.1% or more can be appropriately used. Specifically, polyhydric alcohols, polyhydric alcohol derivatives, nitrogen-containing solvents, alcohols, and sulfur-containing solvents are used.

Examples of polyhydric alcohols include ethylene glycol, diethylene glycol, propylene glycol, butylene glycol, triethylene glycol, 1,5-pentanediol, 1,2,6-hexanetriol, and glycerin.

Examples of polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutylene ether, propylene glycol monobutyl ether, dipropylene glycol monobutyl ether, and ethylene oxide adduct of diglycerin.

Examples of a nitrogen-containing solvent include pyrrolidone, N-methyl-2-pyrrolidone, cyclohexylpyrrolidone, and triethanolamine.

Examples of alcohols include alcohols such as ethanol, iropropyl alcohol, butyl alcohol, and benzyl alcohol.

Examples of a sulfur-containing solvents include thiodiethanol, thiodiglycerol, sulfolane, and dimethyl sulfoxide.

Beside, propylene carbonate and ethylene carbonate can be also used.

Water-soluble solvents used in the present invention may used alone, or may be used by mixing two or more kinds.

A content of a water-soluble solvent is not less than approximately 1% by mass and not more than 60% by mass, preferably not less than approximately 5% by mass and not more than 40% by mass relative to a total mass of ink. When an amount of a water-soluble solvent in a liquid is less than approximately 1% by mass, a sufficient optical density is not obtained in some cases. Conversely, when the amount is more than approximately 60% by mass, a viscosity of a liquid is increased, and spraying property of a liquid is destabilized in some cases.

3-4. Preferable Physical Properties of Ink

A surface tension of ink is preferably not less than approximately 20 mN/m and not more than 60 mN/m, more preferably not less than approximately 20 mN/m and not more than 45 mN/m, further preferably not less than approximately 20 mN/m and not more than 39 mN/m. When a surface tension is less than approximately 20 N/m, a liquid is overflown on a head nozzle surface, and spraying property of ink is deteriorated in some cases. On the other hand, when a surface tension exceeds approximately 6 mN/m, permeability of ink in a paper is slowed, and a drying time is prolonged in some cases.

And, a viscosity of ink is preferably not less than approximately 1.2 mPa·s and not more than 15 mPa·s, more preferably not less than approximately 1.5 mPa·s and less than 10 mPa·s, further preferably not less than approximately 1.8 mPa·s and less than 8 mPa·s. When a viscosity of ink is greater than approximately 15 mPa·s, spraying property of ink is deteriorated in some cases. On the other hand, when the viscosity is smaller than approximately 1.2 mPa·s, spraying stability upon continuous ejection of ink is deteriorated in some cases.

3-5. Water

Water is added to an ink in such a range that the aforementioned surface tension and viscosity are obtained. An addition amount of water is not particularly limited, but preferably not less than approximately 10% by mass and not more than 99% by mass, more preferably not less than approximately 30% by mass, and not more than 80% by mass relative to a total mass of ink.

4. Treating Liquid

In this section, details of a treating liquid used in an ink jet recording method of the present invention are explained.

The treating liquid used in the present invention contains at least an aggregating agent. Each component is explained in detail.

4-1. Aggregating Agent

An aggregating agent used in the present invention refers to a substance having the effect of causing increase in a viscosity or aggregation by a reaction or interaction with components in an ink. Examples of such the substance include a polyvalent metal ion and a cationic substance. Specifically, substance described below, for example, an inorganic electrolyte, an organic amine compound, an organic acid and the like, are effectively used.

Examples of an inorganic electrolyte include salts of an alkali metal ion such as a lithium ion, a sodium ion, and a potassium ion, and a polyvalent metal ion such as an aluminum ion, a barium ion, a calcium ion, a copper ion, an iron ion, a magnesium ion, a manganese ion, a nickel ion, a tin ion, a titanium ion, and a zinc ion, with hydrochloric acid, hydrobromic acid, hydriodic acid, sulfuric acid, nitric acid, phosphoric acid, thiocyanic acid, and organic carboxylic acid such as acetic acid, oxalic acid, lactic acid, fumaric acid, citric acid, salicylic acid, and benzoic acid, or organic sulfonic acid.

Examples include alkali metal salts such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate, and salts of polyvalent metals such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartarate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Examples of an organic amine compound include primary, secondary, tertiary and quaternary amines and salts thereof.

Examples include a tetraalkylammonium salt, an alkylamine salt, a benzalkonium salt, an alkylpyridium salt, an imidazolium salt, and a polyamine, for example, isopropylamine, isobutylamine, t-butylamine, 2-ethylhexylamine, nonylamine, dipropylamine, diethylamine, trimethylamine, triethylamine, dimethylpropylamine, ethylenediaminepropylenediamine, hexamethylenediamine, diethylenetriamine, tetraethylenepentamine, diethanolamine, diethylethanolamine, triethanolamine, tetramethylammonium chloride, tetraethylammonium bromide, dihydroxyethylstearylamine, 2-heptadecenyl-hydroxyethylimidazoline, lauryldimethylbenzylammonium chloride, cetylpyridinium chloride, stearamidomethylpyridinium chloride, a diallyldimethylammonium chloride polymer, diallylamine polymer, and a monoallylamine polymer, as well as an onium salt such as a sulfonium salt, and a phosphonium salt, and phosphoric acid ester of these compounds.

An organic acid is preferably a compound represented by the following formula (1).

Formula (1)

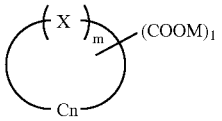

Herein, in the formula, X represents O, CO, NH, NR, S or $SO_2$, and R represents an alkyl group. R is preferably $CH_3$, $C_2H_5$, or $C_2H_4OH$. X is preferably CO, NH, NR or O, more preferably CO, NH or O.

M represents a hydrogen atom, an alkali metal or amine. M is preferably H, Li, Na, K, monoethanolamine, diethanolamine, or triethanolamine, more preferably H, Na, or K, further preferably a hydrogen atom.

And n is an integer of 3 to 7, and n is preferably the case where a heterocyclic ring is a 6-membered ring or a 5-membered ring, more preferably the case where a heterocyclic ring is a 5-membered ring, and m is 1 or 2.

The compound represented by the formula (1) may be a saturated ring or an unsaturated ring as far as the compound is a heterocyclic ring, and 1 is an integer of 1 to 5.

The compound represented by the formula (1) specifically indicates a compound having a furan, pyrrole, pyrroline, pyrrolidone, pyrrone, pyrrole, thiphene, indole, pyridine or quinoline structure, and further having a carboxyl group as a functional group. Specifically, examples include 2-pyrrolidone-5-carboxylic acid, 4-methyl-4-pentanolide-3-carboxylic acid, furancarboxylic acid, 2-bnzofurancarboxylic acid, 5-methyl-2-furancarboxylic acid, 2,5-dimethyl-3-furancarboxylic acid, 2,5-furandicarboxylic acid, 4-butanolide-3-carboxylic acid, 3-hydroxy-4-pyrrone-2,6-dicarboxylic acid, 2-pyrrone-6-carboxylic acid, 4-pyrrone-2-carboxylic acid, 5-hydroxy-4-pyrrone-5-carboxylic acid, 4-pyrrone-2,6-dicarboxylic acid, 3-hydroxy-4-pyrrone-2,6-dicarboxylic acid, thiophenecarboxylic acid, 2-pyrrolecarboxylic acid, 2,3-dimethylpyrrole-4-carboxylic acid, 2,4,5-trimethylpyrrole-3-propionic acid, 3-hydroxy-2-indolecarboxylic acid, 2,5-dioxo-4-methyl-3-pyrroline-3-propionic acid, 2-pyrrolidinecarboxylic acid, 4-hydroxyproline, 1-methylpyrolidine-2-carboxylic acid, 5-carboxy-1-methylpyrolidine-2-acetic acid, 2-pyrilidinecarboxylic acid, 3-pyridinecarboxylic acid, 4-pyridinecarboxylic acid, pyridinedicarboxylic acid, pyridinetricarboxylic acid, pyridinepentacarboxylic acid, 1,2,5,6-tetrahydro-1-methylnicotinic acid, 2-quinolinecarboxylic acid, 4-quinolinecarboxylic acid, 2-phenyl-4-quinolinecarboxylic acid, 4-hydroxy-2-quinolinecarboxylic acid, and 6-methoxy-4-quinolinecarboxylic acid, derivatives of these compounds, and compounds of salts thereof.

The compound represented by the formula (1) is preferably pyrrolidonecarboxylic acid, pyrronecarboxylic acid, pyrrolecarboxylic acid, furancarboxylic acid, pyridincarboxylic acid, coumalic acid, thiphenecarboxylic acid, or nicotinic acid, or derivatives of these compounds, or salts of them. The compound is more preferably pyrrolidonecarboxylic acid, pyrronecarboxylic acid, furancarboxylic acid, coumalic acid, or derivatives of these compounds, or salts of them.

Among them, preferable are magnesium chloride, magnesium bromide, magnesium iodide, magnesium sulfate, magnesium nitrate, magnesium acetate, calcium chloride, calcium bromide, calcium nitrate, calcium dihydrogen phosphate, calcium benzoate, calcium acetate, calcium tartarate, calcium lactate, calcium fumarate, calcium citrate, a diallyldimethylammonium chloride polymer, a diallylamine polymer, a monoallylamine polymer, pyrrolidonecarboxylic acid, pyrronecarboxylic acid, pyrrolecarboxylic acid, furancarboxylic acid, pyridinecarboxylic acid, coumalic acid, thiophenecarboxylic acid, nicotinic acid, potassium dihydrogen citrate, succinic acid, tartaric acid, lactic acid, potassium hydrogen fumarate, or derivatives of these compounds, or salts of them. More preferable are magnesium chloride, magnesium nitrate, calcium nitrate, a diallylamine polymer, pyrrolidonecarboxylic acid, pyrronecarboxylic acid, furancarboxylic acid, coumalic acid, or derivatives of these compounds, or salts of them.

In the present invention, aggregating agents may be used alone, or may be used by mixing two or more kinds.

An addition amount of an aggregating agent in a treating liquid is preferably not less than approximately 0.01% by mass and not more than approximately 30% by mass, more preferably not less than approximately 0.1% by mass and not more than approximately 15% by mass, further preferably not less than approximately 0.25% by mass and not more than approximately 10% by mass relative to a total mass of a treating liquid.

When an addition amount of an aggregating agent in a treating liquid is less than approximately 0.01% by mass, aggregation of a coloring agent becomes insufficient at contact with an ink, and an optical density, bleeding, and bleeding between colors are deteriorated in some cases. On the other hand, when an addition amount exceeds approximately 30% by mass, spraying property is reduced, and a liquid is not normally sprayed in some cases.

4-2. Water-Soluble Solvent

As a water-soluble solvent used in a treating liquid, the same water-soluble solvents as those of ink can be used.

A content of a water-soluble solvent is not less than approximately 1% by mass and not more than approximately 60% by mass, preferably not less than approximately 5% by mass and not more than approximately 40% by mass relative to a total mass of a treating liquid. When an amount of a water-soluble solvent in a treating liquid is less than approximately 1% by mass, a sufficient optical density is not obtained in some cases. Conversely, when the amount is more than approximately 60% by mass, a viscosity of a liquid is increased, and spraying property of a liquid is destabilized in some cases.

4-3. Preferable Physical Properties of Treating Liquid

A surface tension of a treating liquid is preferably not less than approximately 10 mN/m and not more than 45 mN/m, more preferably not less than approximately 15 mN/m and not more than approximately 39 mN/m, further preferably not less than approximately 15 mN/m and not more than approximately 35 mN/m. When a surface tension is less than approximately 10 mN/m, a liquid is overflown on a head nozzle surface, and spraying property of ink is deteriorated in some cases. On the other hand, when a surface tension exceeds approximately 45 mN/m, permeability of ink in a paper is slowed, and a drying time is prolonged in some cases. A surface tension of a treating liquid is preferably smaller than a surface tension of ink. When a rate of spreading a treating liquid is greater than a rate of spreading an ink on a recording medium, feathering is further improved.

A viscosity of a treating liquid is preferably not less than approximately 1.2 mPa·s and not more than approximately 15 mPa·s, more preferably not less than approximately 1.5 mPa·s and less than approximately 10 mPa·s, further preferably not less than approximately 1.8 mPa·s and less than approximately 8 mPa·s. When a viscosity of ink is greater than approximately 15 mPa·s, spraying property of ink is deteriorated in some cases. On the other hand, when the viscosity is smaller than approximately 1.2 mPa·s, spraying stability upon continuous ejection of ink is deteriorated in some cases.

A viscosity and a surface tension are preferably adjusted so that spreading of a dot is greater with a treating liquid than with an ink when amounts of droplets of a treating liquid and an ink are the same. When spreading of a treating liquid is greater, feathering is further improved.

In the present invention, a pH of a treating liquid containing the compound represented by the formula (1) is preferably not less than approximately 1.5 and not more than approximately 12.0, further preferably not less than approximately 2.0 and not more than approximately 7.5, more preferably not less than approximately 2.5 and not more than approximately 6.0. When a pH of a treating liquid is less than approximately 1.5, an ink path-constituting portion of a printing head is dissolved, and a printing head became out of order in some cases. On the other hand, when a pH of a treating liquid exceeds approximately 12.0, aggregation of a coloring agent becomes insufficient at contact with an ink, and an optical density, bleeding, and bleeding between colors are deteriorated in some cases.

The number of coarse particles of 5 μm or larger in a mixture of ink and a treating liquid is preferably not less than approximately 500/μL, more preferably not less than approximately 500/μL and not more than approximately 10,000/μL, further preferably not less than approximately 500/μL and not more than approximately 3,000/μL. When the number of coarse particles of 5 μm or larger in a mixture of ink and a treating liquid is less than approximately 500/μL, an optical density is reduced in some cases.

In the present invention, the number of coarse particles of 5 μm or larger in a mixture of ink and a treating liquid was measured by mixing two liquids at a ratio of 1:1 by mass ratio, taking 2 μL while stirring, and measuring the number using Accusizer TM770 Optical Particle Sizer (manufactured by Particle Sizing Systems). As a parameter at measuring, a density of a coloring agent is inputted as a density of dispersed particles. This density of a coloring agent can be obtained by heating and drying a coloring agent dispersion to obtain a coloring agent powder, and measuring a density of the powder using a gravimeter or a pycnometer.

4-4. Water

Water is added to a treating liquid in such a range that the aforementioned surface tension and viscosity are obtained. An addition amount of water is not particularly limited, but is preferably not less than approximately 10% by mass and not more than approximately 99% by mass, more preferably not less than approximately 30% by mass and not more than approximately 80% by mass relative to a total mass of a treating liquid.

4-5. Coloring Agent

In addition, if desired, a treating liquid may contain a coloring agent. As a coloring agent to be contained in a treating liquid, the same coloring agents as those explained as a coloring agent for an ink can be used. Preferably, a dye, a pigment having a sulfonic acid or a sulfonate salt on a surface, an anionic self-dispersible pigment, or a cationic self-dispersible pigment is used. Since these coloring agents are aggregated in an acidic region with difficulty, and have the effect of improving storage stability of a treating liquid, they are thought to be preferable.

5. Other Additives

Additives which can be appropriately used in an ink and a treating liquid will be explained below.

In an ink and a treating liquid, a surfactant may be used. As a surfactant in the present invention, a compound having a structure having both of a hydrophilic part and a hydrophobic part in a molecule can be effectively used, and any of an anionic surfactant, a cationic surfactant, an amphoteric surfactant, and a nonionic surfactant can be used. Further, the aforementioned polymer material (polymer dispersant) can be also used as a surfactant.

As the anionic surfactant, alkylbenzenesulfonate salt, alkylphenylsulfonate salt, alkylnaphthalenesulfonate salt, higher fatty acid salt, sulfate ester salt of higher fatty acid ester, sulfonate salt of higher fatty acid ester, sulfate ester salt and sulfonate salt of higher alcohol ether, higher alkylsulfosuccinate salt, higher alkylphosphate ester salt, and phosphate ester salt of higher alcohol ethylene oxide adduct can be used. Specifically, for example, dodecylbenzenesulfonate salt, kerylbenzenesulfonate salt, isopropylnaphthalenesulfonate salt, monobutylphenylphenolmonosulfonate salt, monobutylbiphenylsulfonate salt, monobutylbiphenylsulfonate salt, and dibutylphenylphenoldisulfonate salt are effectively used.

Examples of the nonionic surfactant include polypropylene glycol ethylene oxide adduct, polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylolamide, acetylene glycol, oxyethylene adduct of acetylene glycol, aliphatic alkanolamide, glycerin ester, and sorbitan ester.

Examples of the cationic surfactant include a tetraalkylammonium salt, an alkylamine salt, a benzalkonium salt, alkylpyridinium salt, and an imidazolium salt, specifically, for example, dihydroxyethylstearylamine, 2-heptadecenyl-hydroxyethylimidazoline, lauryldimethylbenzylammonium chloride, cetylpyridinium chloride, and stearamidomethylpyridinium chloride.

Besides, biosurfactants such as spicryspolic acid, rhamnolipid, and lysolecithin can be also used.

An amount of a surfactant to be added to an ink and a treating liquid in the present invention is preferably less than approximately 10% by mass, more preferably approximately 0.01 to 5% by mass, further preferably in a range of approximately 0.01 to 3% by mass. When an addition amount is approximately 10% by mass or more, an optical density, and storage stability of a pigment ink are deteriorated in some cases.

Besides, for the purpose of property control such as ejection property improvement, polyethyleneimine, polyamines, polyvinylpyrrolidone, polyethylene glycol, cellulose derivatives such as ethylcellulose, and carboxymethylcellulose, polysaccharides and derivatives thereof, water-soluble polymer, polymer emulsion such as acryl-based polymer emulsion, polyurethane-based emulsion, and hydrophilic-latex, hydrophilic polymer gel, cyclodextrin, macrocyclic amines, dendrimer, crown ethers, urea and derivatives thereof, acetamide, silicone-based surfactant, and fluorine-based surfactant may be added to an ink and a treating liquid.

In addition, in order to adjust an electric conductivity and a pH, compounds of alkali metals such as potassium hydroxide, sodium hydroxide, and lithium hydroxide, nitrogen-containing compounds such as ammonium hydroxide, triethanolamine, diethanolamine, ethanolamine, and 2-amino-2-methyl-1-propanol, compounds of alkaline earth metals such as calcium hydroxide, acids such as sulfuric acid, hydrochloric acid, and nitric acid, and salts of strong acids and weak alkalis such as ammonium sulfate may be added.

If necessary, pH buffers, antioxidants, anti-mold agents, viscosity adjusting agents, electric conductive agents, and ultraviolet absorbing agents may be added.

Examples of the present invention will be explained below, but the present invention is not limited to these Examples at all.

EXAMPLE

Liquid Preparing Method

Appropriate amounts of a coloring agent solution, a water-soluble solvent, a surfactant, and ion-exchanged water are added so that a prescribed composition is obtained, and the mixed solution is mixed and stirred. The resulting liquid is passed through a 5 μm filter to obtain a desired liquid.

(Liquid A: Ink)

Cabojet-300(carboxylic acid group/Manufactured by Cabbot) 4% by mass

Styrene-acrylic acid copolymer (Acid value 100/neutralization level 95%) 0.5% by mass Diethylene glycol 25% by mass Acetylene glycol ethylene oxide adduct 0.4% by mass Ion-exchanged water Balance This liquid A has a pH of 7.4, a surface tension of 35 mN/n, and a viscosity of 3.2 mPa·s.

(Liquid B: Treating Liquid)

Dietyhlene glycol 30% by mass

Magnesium nitrate hexahydrate 7.5% by mass

Acetylene glycol ethylene oxide adduct 1% by mass

Ion-exchanged water Balance

This liquid B has a pH of 5.6, a surface tension of 31 mN/m, and a viscosity of 2.9 mPa·s.

Examples 1 to 5 and Comparative Example 1

Printing is performed by using a double-sided printable image recording experimental apparatus which is two-liquid printing method and has a fixed recording head having a printing region of a recording medium width. The treating liquid (Liquid B) is ejected to a C2 paper (manufactured by Fuji Xerox Co., Ltd.), and then the ink Liquid A) is ejected to the C2 paper.

Printing is performed by adjusting impartation amounts per unit area ($m^2$) of a Liquid A (ink) and a Liquid B (treating liquid) as described in the following Table 1, and the resulting sample is assessed. Thereupon, printing is performed under general environment (temperature 23±0.5° C., humidity 55±5% R.H).

Assessment Method

Assessment of image quality is performed by measuring an optical density.

○, $\Delta^+$, Δ, and $\Delta^-$ are in a practically implementable range, and x is practically problematic.

○: 1.4 or more $\Delta^+$: not less than 1.2 and less than 1.4

Δ: not less than 1.1 and less than 1.2

$\Delta^-$: not less than 1.0 and less than 1.1

Assessment of deformation of a paper is performed by measuring a curvature radius of a curl.

○, $\Delta^+$, Δ, and $\Delta^-$ are in a practically implementable range, and x is practically problematic.

○: 30 cm or more $\Delta^+$: not less than 20 cm and not more than 30 cm

Δ: not less than 10 cm and not more than 20 cm $\Delta^-$: not less than 5 cm and not more than 10 cm Results are shown in Table 1.

TABLE 1

| | Front Surface | | Back surface | | | | |
|---|---|---|---|---|---|---|---|
| | Ink amount (ng) | Treating liquid amount (ng) | Ink amount (ng) | Treating liquid amount (ng) | Front Surface image quality | Paper deformation | Back surface image quality |
| Example 1 | 10 | 2 | 10 | 2 | $\Delta^+$ | $\Delta^-$ | Δ |
| Example 2 | 10 | 0 | 10 | 0 | Δ | Δ | Δ |
| Example 3 | 10 | 0 | 8 | 2 | Δ | Δ | Δ |
| Example 4 | 8 | 2 | 10 | 4 | Δ | $\Delta^+$ | $\Delta^+$ |
| Example 5 | 8 | 2 | 8 | 2 | Δ | $\Delta^+$ | Δ |
| Comparative Example 1 | 10 | 4 | 10 | 4 | ○ | X | X |

Example 6

On both of a front surface and a back surface, a treating liquid is imparted to only a portion of letters and line drawing and, regarding other images, a treating liquid is not imparted, thereby, a sample is prepared.

The treating liquid is imparted to a portion of letters and line drawing so that an impartation amount of a treating liquid per pixel is the same amount as that in the case of Comparative Example 1.

Example 7

On both of a front surface and a back surface, a treating liquid is not imparted to a portion in which images of a front surface and a back surface are overlapped (overlapped portion), and the treating liquid is imparted to other portions, thereby, a sample is prepared.

The treating liquid is imparted to portions other than an overlapped portion so that an impartation amount of a treating liquid per pixel is the same amount as that in the case of Comparative Example 1.

Example 8

Printing is performed on a single-sided coated paper (trade name: Superfine coated paper manufactured by Epson OA Supply), a treating liquid is not imparted to a front surface (coated side), and the treating liquid is imparted to a back surface to the same amount as that in the case of Comparative Example 1.

Assessment of Examples 6 to 8

Regarding Examples 6 to 8, assessment was performed according to the same manner as that of Examples 1 to 5. Results are shown in Table 2.

TABLE 2

| | Impartation method | Front Surface image quality | Paper deformation | Back surface image quality |
|---|---|---|---|---|
| Example 6 | Treating liquid is imparted only to letters and line drawing region. | $\Delta^+$ | Δ | $\Delta^+$ |
| Example 7 | Treating liquid is not imparted to an overlapped part. | Δ | Δ | Δ |

TABLE 2-continued

| | Impartation method | Front Surface image quality | Paper deformation | Back surface image quality |
|---|---|---|---|---|
| Example 8 | Treating liquid is not imparted to a coated side in a single-sided coated paper. | ○ | $\Delta^+$ | ○ |

What is claimed is:

1. A double-sided printable image recording apparatus comprising:

a conveyer to convey a recording medium;

a fixed recording head to eject an aqueous ink and a treating liquid capable of aggregating a colorant contained in the aqueous ink to the recording medium conveyed by the conveyer, the fixed recording head being arranged in a direction substantially orthogonal to a conveying direction of the recording medium, and having a printing region corresponding to the width of the recording medium; and an ejection controller to control ejection of the aqueous ink and the treating liquid from the fixed recording head based on image information, wherein the ejection controller, in a double-sided printing mode for printing on both sides of the recording medium, controls an ejection amount of the treating liquid ejected on a front surface of the recording medium per sheet of the recording medium to a smaller amount than the amount in a single-sided printing mode for printing only on one side.

2. The image recording apparatus of claim 1, wherein the ejection controller, in the double-sided printing mode, controls ejection so that the treating liquid is ejected to neither the front surface nor a back surface of the recording medium.

3. The image recording apparatus of claim 1, wherein the ejection controller, in the double-sided printing mode, ejects the treating liquid only to a region of letters and line drawing.

4. The image recording apparatus of claim 1, wherein the ejection controller, in the double-sided printing mode, does not eject the treating liquid on the front surface of a recording medium, and controls ejection of the ink on a back surface of the recording medium so that an optical density is lower than the optical density on the front surface, and controls ejection so that the treating liquid is ejected on the back surface.

5. The image recording apparatus of claim 1, wherein the ejection controller, in the double-sided printing mode, controls ejection of the ink on the front surface of the recording medium so that an optical density is lower than the optical density of an image in a single-sided printing mode.

6. The image recording apparatus of claim 5, wherein the ejection controller, in the double-sided printing mode, controls ejection of the ink on a back surface of the recording medium so that the optical density is lower than the optical density of an image on the front surface, and controls an ejection amount of the treating liquid on the back surface so that it is smaller than an ejection amount of the treating liquid per sheet of recording medium in a single-sided printing mode.

7. The image recording apparatus of claim 1, wherein the ejection controller, in the double-sided printing mode, controls ejection so that the treating liquid is not imparted to a region in which ejection of the ink is overlapped between the front surface and the back surface of the recording medium, based on image information.

8. The image recording apparatus of claim 1, wherein the recording medium is a single-sided coated paper having a coated surface, and the ejection controller, in the double-sided printing mode, controls ejection of the ink so that the treating liquid is not ejected on the front surface which is the coated surface of the recording medium, and an optical density on a back surface which is a non-coated side is the approximately same as the optical density of an image on the coated surface and controls ejection so that the treating liquid is ejected onto the back surface.

9. The image recording apparatus of claim 1, wherein the ejection controller, in the double-sided printing mode, controls an ejection amount of the ink on a back surface of the recording medium to a smaller amount than the amount of the ink in the single-sided printing mode.

10. The image recording apparatus of claim 9, wherein the ejection controller, in the double-sided printing mode, controls an ejection amount of the treating liquid on a back surface of the recording to a smaller amount than the amount of the treating liquid in the single-sided printing mode.

11. The image recording apparatus of claim 1, wherein the ejection controller, in the double-sided printing mode, does not eject the treating liquid on the front surface of a recording medium, and controls an ejection amount of the ink on a back surface of the recording medium to a smaller amount than the amount of the ink in the single-sided printing mode.

12. The image recording apparatus of claim 11, wherein the ejection controller, in the double-sided printing mode, controls an ejection amount of the treating liquid on a back surface of the recording medium to a smaller amount than the amount of the treating liquid in the single-sided printing mode.

13. The image recording apparatus of claim 1, wherein the ejection controller, in the double-sided printing mode, does not eject the treating liquid on the front surface of a recording medium, and controls an ejection amount of the treating liquid on a back surface of the recording medium to a smaller amount than the amount of the treating liquid in the single-sided printing mode.

14. The image recording apparatus of claim 1, wherein the ejection controller, in the double-sided printing mode, controls an ejection amount of the ink on a front surface of the recording medium to a smaller amount than the amount of the ink in the single-sided printing mode.

15. The image recording apparatus of claim 14, wherein the ejection controller, in the double-sided printing mode, controls an ejection amount of the ink on a back surface of the recording medium to a smaller amount than the amount of the ink in the single-sided printing mode.

16. The image recording apparatus of claim 15, wherein the ejection controller, in the double-sided printing mode, controls an ejection amount of the treating liquid on a back surface of the recording medium to a smaller amount than the amount of the treating liquid in the single-sided printing mode.

17. The image recording apparatus of claim 14, wherein the ejection controller, in the double-sided printing mode, controls an ejection amount of the treating liquid on a back surface of the recording medium to a smaller amount than the amount of the treating liquid in the single-sided printing mode.

18. The image recording apparatus of claim 1, wherein the ejection controller, in the double-sided printing mode, controls an ejection amount of the treating liquid to a region in which ejection of the ink is overlapped between the front surface and the back surface of the recording medium to a smaller amount than the amount of the treating liquid in the single-sided printing mode, based on image information.

* * * * *